US010767346B2

(12) United States Patent
Honda et al.

(10) Patent No.: US 10,767,346 B2
(45) Date of Patent: Sep. 8, 2020

(54) WORK MACHINE

(71) Applicant: Kubota Corporation, Osaka-shi (JP)

(72) Inventors: Keigo Honda, Sakai (JP); Yuji Fukuda, Sakai (JP); Takahiro Usami, Sakai (JP); Hiroshi Fujiwara, Sakai (JP)

(73) Assignee: KUBOTA CORPORATION, Osaka-Shi (JP)

( * ) Notice: Subject to any disclaimer, the term of this patent is extended or adjusted under 35 U.S.C. 154(b) by 0 days.

(21) Appl. No.: 16/427,353

(22) Filed: May 31, 2019

(65) Prior Publication Data

US 2020/0024830 A1 Jan. 23, 2020

(30) Foreign Application Priority Data

Jul. 20, 2018 (JP) ..... 2018-137186

(51) Int. Cl.
*E02F 9/22* (2006.01)
*E02F 9/08* (2006.01)

(52) U.S. Cl.
CPC ..... *E02F 9/2285* (2013.01); *E02F 9/0875* (2013.01); *E02F 9/226* (2013.01); *E02F 9/0883* (2013.01)

(58) Field of Classification Search
CPC ..... B60K 7/0015; F15B 1/024; F15B 21/12; E02F 9/0875; E02F 9/226; E02F 9/0883
USPC ..... 60/420
See application file for complete search history.

(56) References Cited

U.S. PATENT DOCUMENTS 5,507,530 A * 4/1996 Mahaney ..... E02F 3/3654 285/124.1
6,543,563 B1 4/2003 Muraro

FOREIGN PATENT DOCUMENTS

JP 4108912 B2 4/2002
JP 2009-287281 12/2009

* cited by examiner

*Primary Examiner* — Thomas E Lazo
*Assistant Examiner* — Daniel S Collins
(74) *Attorney, Agent, or Firm* — Mori & Ward, LLP

(57) ABSTRACT

A work machine includes a hydraulic actuator configured to be driven via hydraulic oil. A control valve has a first pilot port and is connected to the hydraulic actuator to control the hydraulic actuator. The hydraulic actuator is configured to move in a first mode when a first pilot pressure is applied to the first pilot port. A first pilot valve is connected to the first pilot port of the control valve via the first pilot oil supply pipe to control applying the first pilot pressure to the first pilot port. The hydraulic oil is configured to be drained via a drain pipe. The drain pipe and the first pilot oil supply pipe are provided in a heat exchanger to exchange heat between the hydraulic oil in the drain pipe and the hydraulic oil in the first pilot oil supply pipe via the heat exchanger.

22 Claims, 24 Drawing Sheets

WORK MACHINE

CROSS-REFERENCE TO RELATED APPLICATIONS

The present application claims priority under 35 U. S. C. § 119 to Japanese Patent Application No. 2018-137186, filed Jul. 20, 2018. The contents of this application are incorporated herein by reference in their entirety.

BACKGROUND OF THE INVENTION

Field of the Invention

The present invention relates to a work machine.

Discussion of the Background

The work machine disclosed in JP 2009-287281 A has been known.

The work machine disclosed in JP 2009-287281 A includes hydraulic actuators (bucket cylinder and boom cylinder) configured to be driven by hydraulic oil, a plurality of control valves (work control valves) configured to control the hydraulic actuators, a plurality of pilot valves (work operation lever) configured to adjust the hydraulic oil serving as pilot oil, a plurality of first pipe members (work pilot hoses) respectively coupled to the plurality of pilot valves and configured to allow the pilot oil output from the plurality of pilot valves to flow, a plurality of second pipe members (work pilot hoses) respectively coupled to pressure receivers of the plurality of control valves, and a relay member coupling the plurality of first pipe members and the plurality of second pipe members, respectively.

SUMMARY OF THE INVENTION

According to one aspect of the present invention, a work machine includes a hydraulic actuator, a control valve, a first pilot oil supply pipe, a first pilot valve, a drain pipe, and a heat exchanger. The hydraulic actuator is configured to be driven via hydraulic oil. The control valve has a first pilot port and is connected to the hydraulic actuator to control the hydraulic actuator. The hydraulic actuator is configured to move in a first mode when a first pilot pressure is applied to the first pilot port. The first pilot valve is connected to the first pilot port of the control valve via the first pilot oil supply pipe to control applying the first pilot pressure to the first pilot port. The hydraulic oil is configured to be drained via the drain pipe. The drain pipe and the first pilot oil supply pipe are provided in the heat exchanger to exchange heat between the hydraulic oil in the drain pipe and the hydraulic oil in the first pilot oil supply pipe via the heat exchanger.

According to another aspect of the present invention, a work machine includes a hydraulic pump, a hydraulic actuator, a control valve, a first pilot oil supply pipe, an additional oil supply pipe, a first pilot valve, an additional drain pipe, and a heat exchanger. The hydraulic pump is configured to supply hydraulic oil. The hydraulic actuator is configured to be driven via the hydraulic oil. The control valve has a first pilot port and is connected to the hydraulic actuator to control the hydraulic actuator. The hydraulic actuator is configured to move in a first mode when a first pilot pressure is applied to the first pilot port. The first pilot valve is connected to the hydraulic pump via the additional oil supply pipe to receive the hydraulic oil and is connected to the first pilot port of the control valve via the first pilot oil supply pipe to control applying the first pilot pressure to the first pilot port. The additional drain pipe is connected to the additional oil supply pipe. The hydraulic oil is configured to be drained via the additional drain pipe. The additional drain pipe and the first pilot oil supply pipe are provided in the heat exchanger to exchange heat between the hydraulic oil in the additional drain pipe and the hydraulic oil in the first pilot oil supply pipe via the heat exchanger.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DETAILED DESCRIPTION OF EMBODIMENTS

Figure 1:
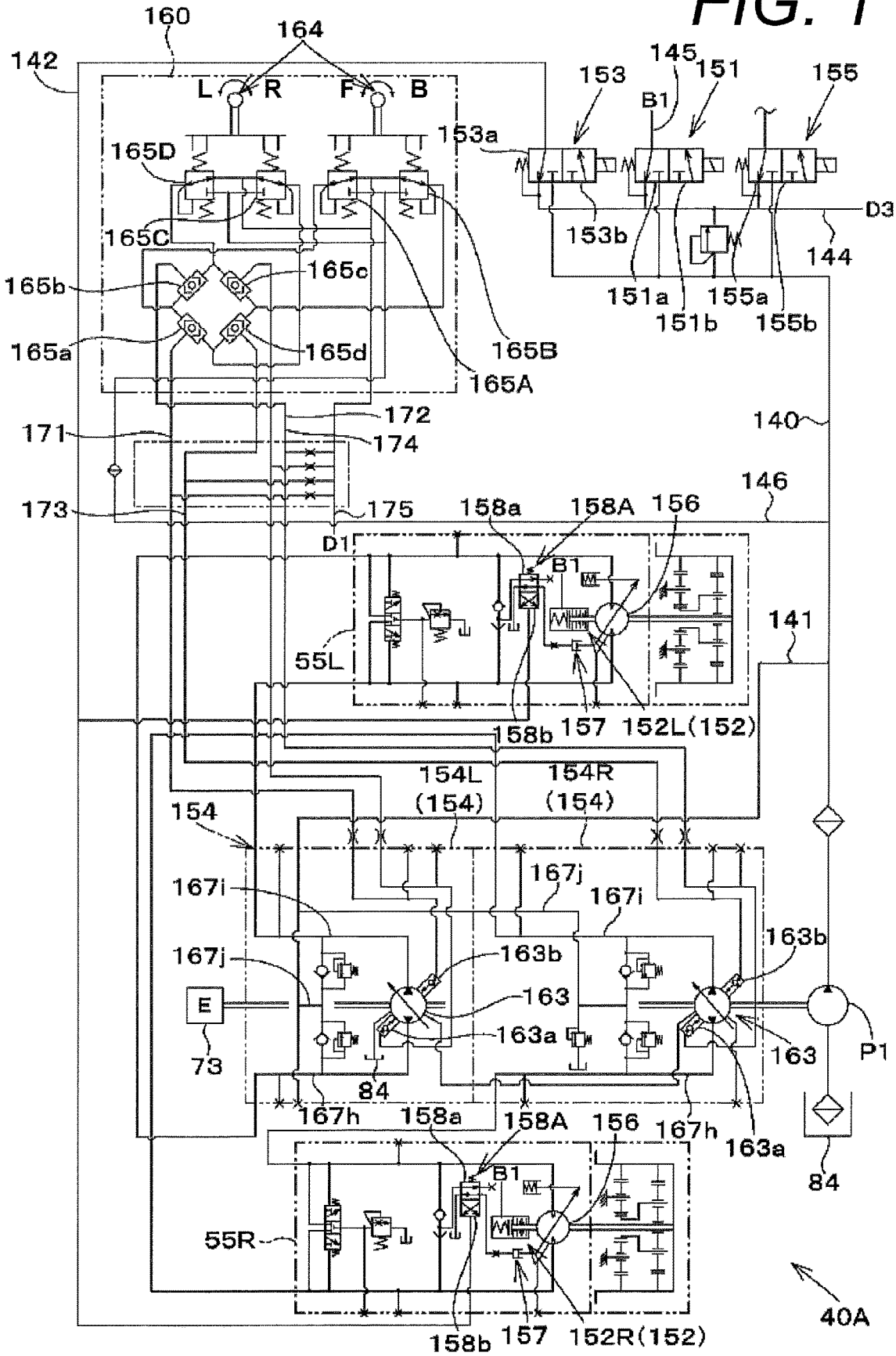
FIG. 1 is a schematic diagram of a travel-relating hydraulic system of a work machine.

The embodiments will now be described with reference to the accompanying drawings, wherein like reference numerals designate corresponding or identical elements throughout the various drawings.

In the work machine in JP 2009-287281 A, the plurality of first pipe members and the plurality of second pipe members are coupled via the relay member. The first pipe members and the second pipe members can thus be easily arranged. A time for attaching the first pipe members and the second pipe members can therefore be shortened, reducing a cost for producing the work machine.

However, when the work machine in JP 2009-287281 A is used and started under a low temperature condition, i.e., when the work machine is used and started in a cold region, for example, a temperature of the pilot oil is low, and thus viscosity of the hydraulic oil is high. The work machine thus requires warming up to warm up the pilot oil.

In view of the problem observed in the conventional techniques, the present invention has an object to improve ease of start-up of a work machine even under a low temperature condition by allowing pilot oil to exchange heat inside a relay member.

An embodiment of the present invention will now be described herein with reference to the drawings.

Figure 10:
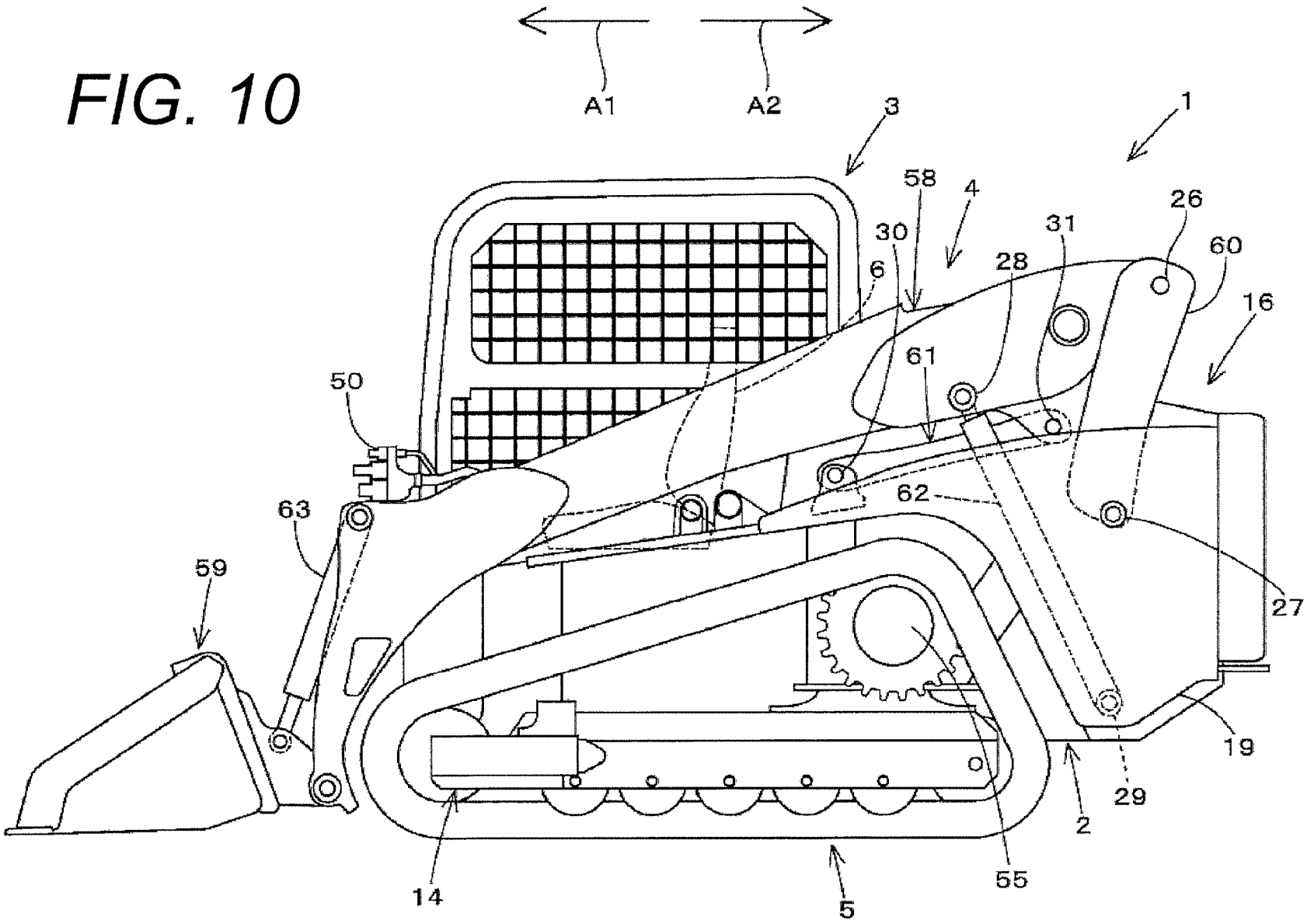
FIG. 10 is a left side view of the work machine.

FIG. 10 illustrates a side view of a work machine 1 according to the present invention. FIG. 10 illustrates a compact track loader as an example of the work machine 1. However, the work machine 1 according to the present invention is not limited to a compact track loader. The work machine 1 may be another type such as skid-steer loader.

As illustrated in FIG. 10, the work machine 1 includes a machine body (vehicle body) 2, a cabin 3, a work device 4, and traveling devices 5. The cabin 3 is mounted on a front side of the machine body 2. A driver's seat 6 is provided inside the cabin 3. In the embodiment of the present invention, it is assumed that a front side (left side in FIG. 10) of a driver sitting on the driver's seat 6 of the work machine 1 is a forward direction, a back side (right side in FIG. 10) of the driver is a backward direction, a left side (near side in FIG. 10) of the driver is a leftward direction, and a right side (far side in FIG. 10) of the driver is a rightward direction. A horizontal direction orthogonal to a front-rear direction will be referred to as a width direction in the following description.

Furthermore, it is assumed that a rightward or leftward direction from a central part of the machine body 2 will be referred to as a machine body outward direction. In other words, the machine body outward direction denotes the width direction that is a direction away from the machine body 2. Furthermore, it is assumed that a direction opposite to the machine body outward direction will be referred to as a machine body inward direction. In other words, the machine body inward direction is a direction toward the machine body 2 along the width direction. In FIG. 10, an arrow A1 indicates the forward direction, and an arrow A2 indicates the backward direction.

A driver's exit (not illustrated) for a driver getting on and off is provided on a front surface of the cabin 3. This driver's exit can be opened and closed by a transparent front panel (not illustrated). This front panel can be opened and closed from an outer side of the cabin 3 (cabin exterior) and an inner side (cabin interior).

As illustrated in FIG. 10, the work device 4 includes booms 58, a work tool 59, lift links 60, control links 61, boom cylinders 62, and bucket cylinders 63.

The booms 58 are provided to be swingable in an upper-lower direction on a right side and a left side of the cabin 3. The work tool 59 is a bucket, for example. The bucket 59 is provided to be swingable in the upper-lower direction on leading end parts (front end parts) of the booms 58. The lift links 60 and the control links 61 support base parts (back parts) of the booms 58 to allow the booms 58 to be swingable in the upper-lower direction. The boom cylinders 62 are hydraulic actuators configured to extend and contract to lift up and down the booms 58. The bucket cylinders 63 are hydraulic actuators configured to extend and contract to allow the bucket 59 to swing.

Front parts of the booms 58 on the left side and the right side are coupled with each other through a curved and forked coupling pipe. The base parts (back parts) of the booms 58 are coupled with each other through a circular coupling pipe.

The lift links 60, the control links 61, and the boom cylinders 62 are provided on a left side and a right side of the machine body 2 to correspond to the booms 58 on the left side and the right side.

The lift links 60 are respectively vertically provided on the back parts of the base parts of the booms 58. Upper parts (one end sides) of the lift links 60 are pivoted rotatably about a horizontal axis closer to the back parts of the base parts of the booms 58 through a pivotal shaft 26 (first pivotal shaft). Lower parts (other end sides) of the lift links 60 are pivoted rotatably about the horizontal axis closer to a back part of the machine body 2 through a pivotal shaft 27 (second pivotal shaft). The second pivotal shaft 27 is provided below the first pivotal shaft 26.

Upper parts of the boom cylinders 62 are pivoted rotatably about the horizontal axis through a pivotal shaft 28 (third pivotal shaft). The third pivotal shaft 28 is provided on the front parts of the base parts of the booms 58. Lower parts of the boom cylinders 62 are pivoted rotatably about the horizontal axis through a pivotal shaft 29 (fourth pivotal shaft). The fourth pivotal shaft 29 is provided closer to a lower part of the back part of the machine body 2 and below the third pivotal shaft 28.

As illustrated in FIG. 10, the control links 61 are respectively provided in front of the lift links 60. Ends of the control links 61 are pivoted rotatably about the horizontal axis through a pivotal shaft 30 (fifth pivotal shaft). The fifth pivotal shaft 30 is provided on the machine body 2 at positions corresponding to front sides of the lift links 60. Other ends of the control links 61 are pivoted rotatably about the horizontal axis through a pivotal shaft 31 (sixth pivotal shaft). The sixth pivotal shaft 31 is provided, on the booms 58, in front of the second pivotal shaft 27 and above the second pivotal shaft 27.

As the boom cylinders 62 extend and contract, while the base parts of the booms 58 are supported by the lift links 60 and the control links 61, the booms 58 swing about the first pivotal shaft 26 in the upper-lower direction. The leading end parts of the booms 58 thus move up and down. As the booms 58 swing in the upper-lower direction, the control links 61 swing about the fifth pivotal shaft 30 in the upper-lower direction. As the control links 61 swing in the upper-lower direction, the lift links 60 swing about the second pivotal shaft 27 in the front-rear direction.

Instead of the bucket 59, another work tool is attachable to the front parts of the booms 58. Examples of the other work tool include attachments (auxiliary attachments) such as a hydraulic crusher, a hydraulic breaker, an angle broom, an earth auger, a pallet folk, a sweeper, a mower, and a snow blower.

As illustrated in FIG. 10, a coupling member 50 is provided at the front part of the left side one of the booms 58. The coupling member 50 is a device configured to couple a hydraulic instrument provided on an auxiliary attachment and pipe members such as pipes and hoses provided on the booms 58.

The bucket cylinders 63 are respectively arranged closer to front parts of the booms 58. As the bucket cylinders 63 extend and contract, the bucket 59 swings.

As illustrated in FIG. 10, crawler type traveling devices are adopted as the traveling devices 5 in the present embodiment. The traveling devices 5 are provided on the left side and the right side of the machine body 2. The traveling devices 5 may be wheel type traveling devices.

Next, a hydraulic system of the work machine 1 according to the present invention will be described.

Figure 2A:
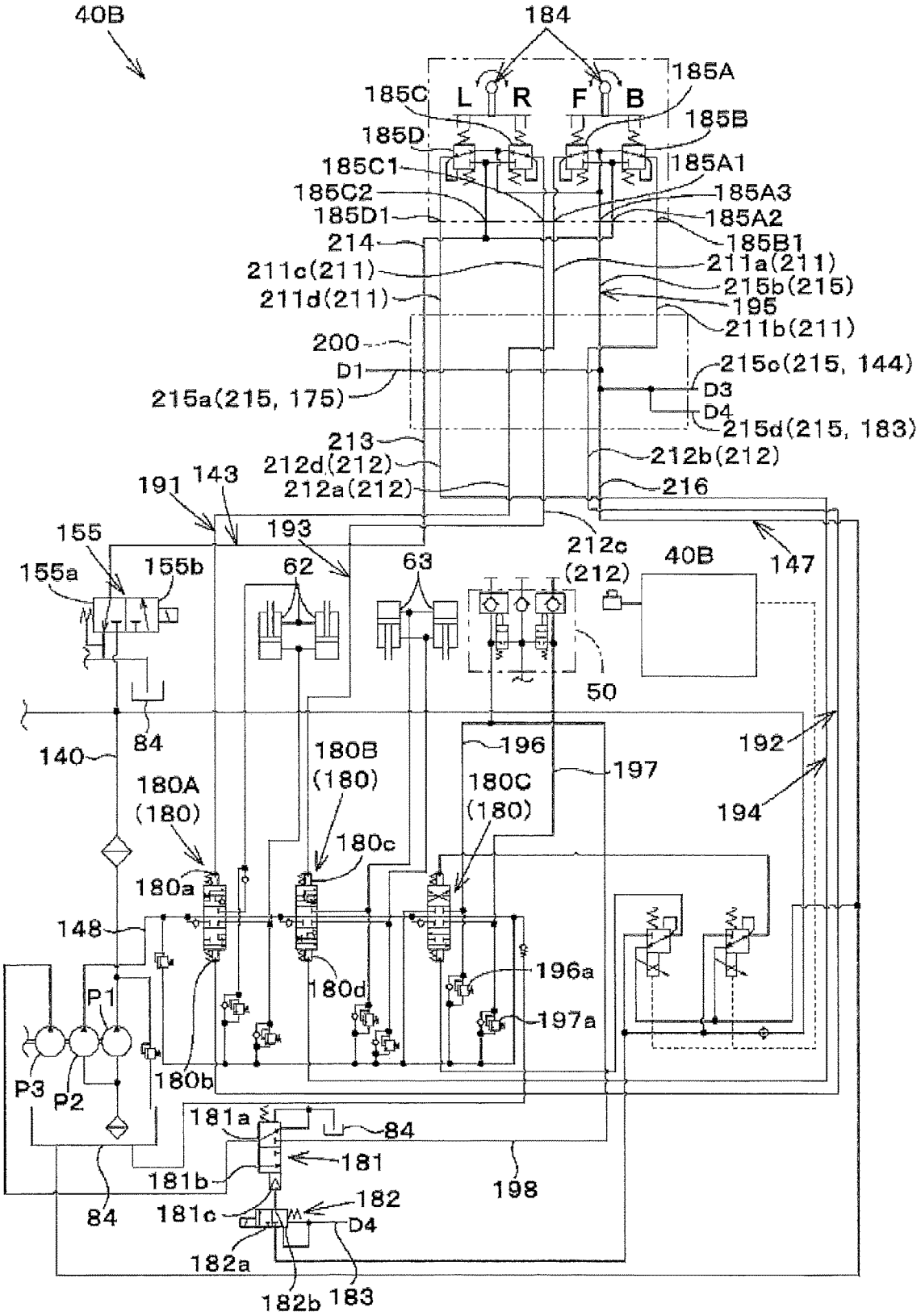
FIG. 2A is a schematic diagram of a work-relating hydraulic system of the work machine.
Figure 2B:
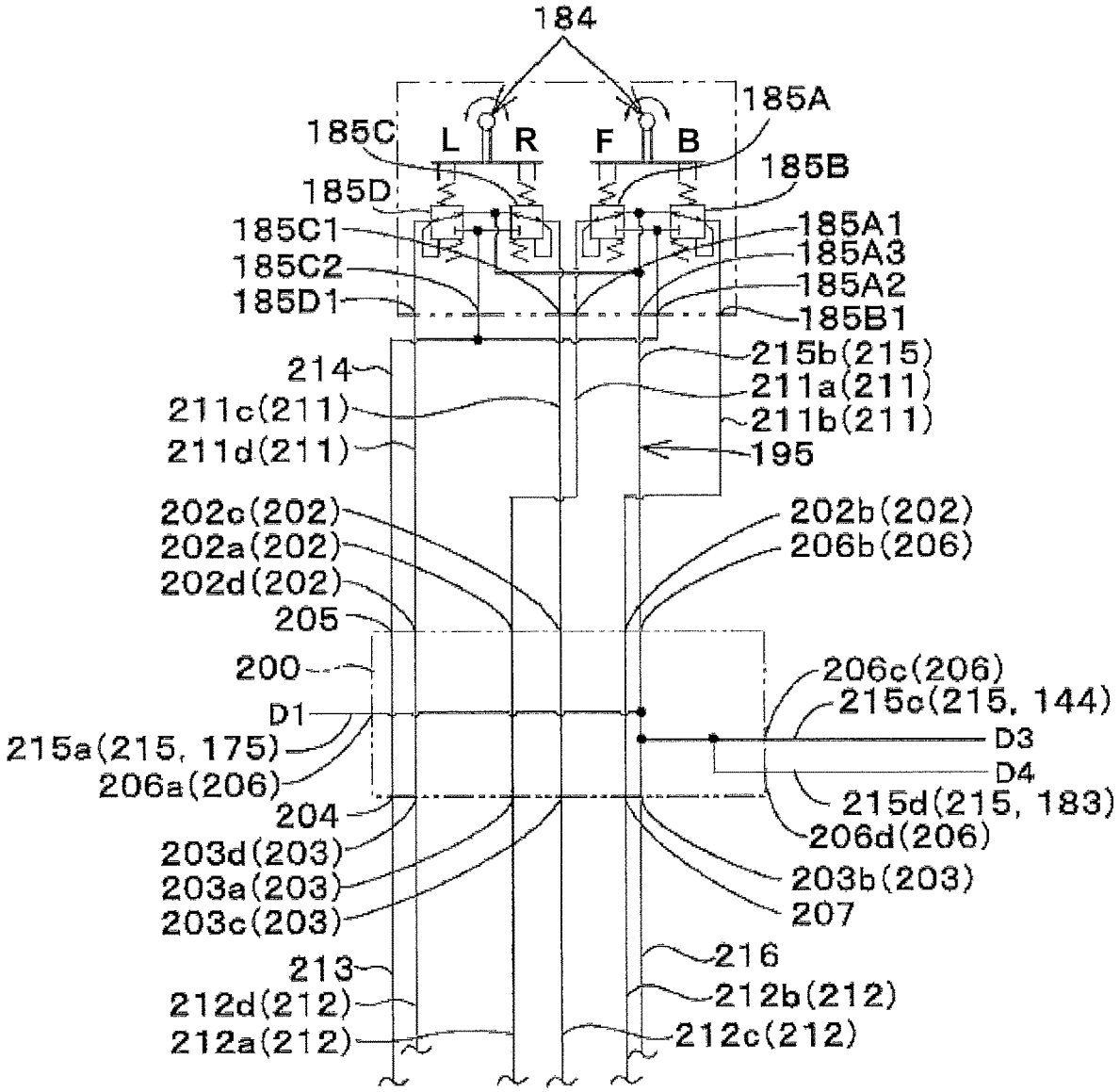
FIG. 2B is an enlarged view of a hydraulic system around a relay member.
Figure 3:
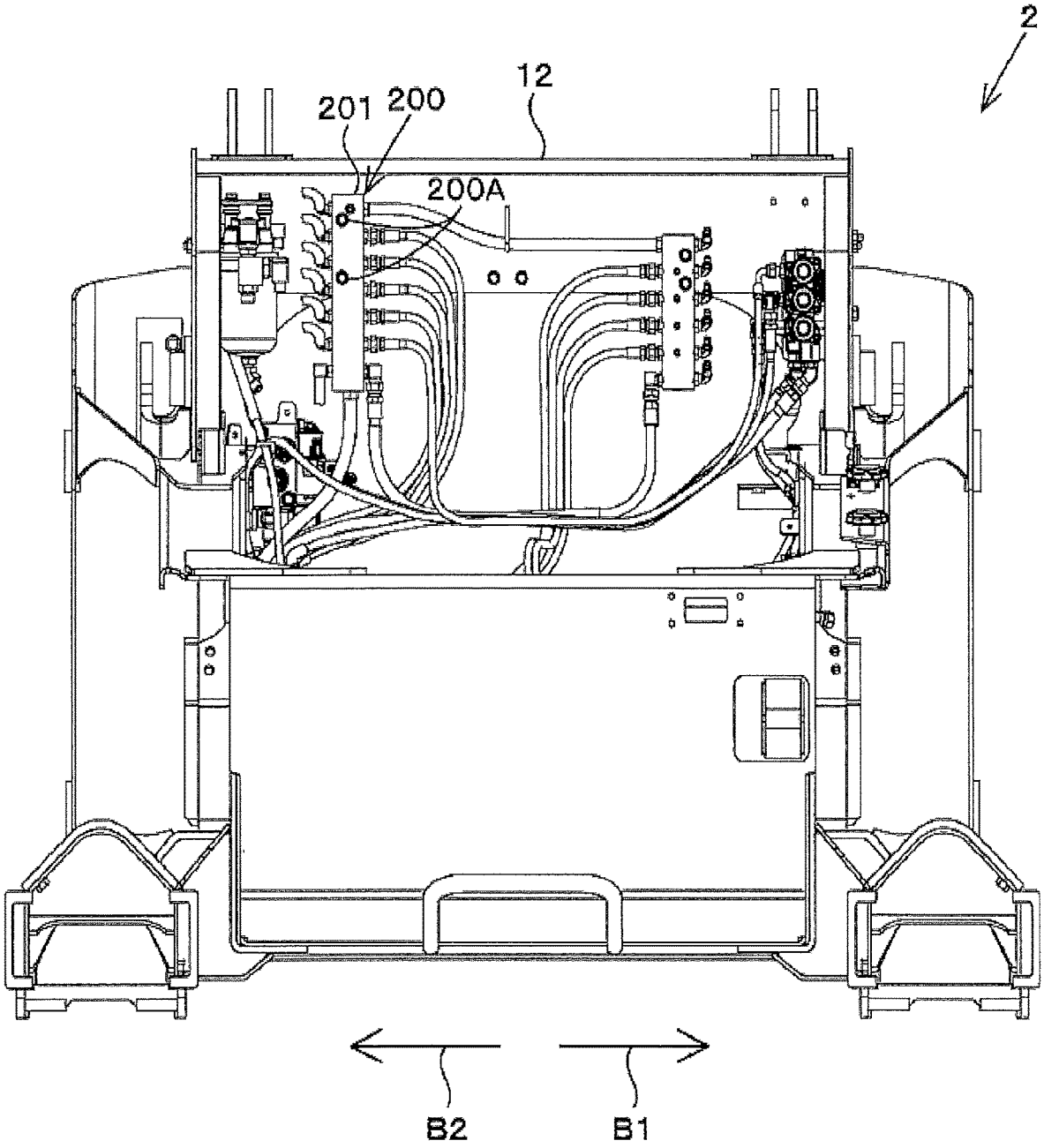
FIG. 3 is a front view illustrating a machine body and the relay member, for example.
Figure 4:
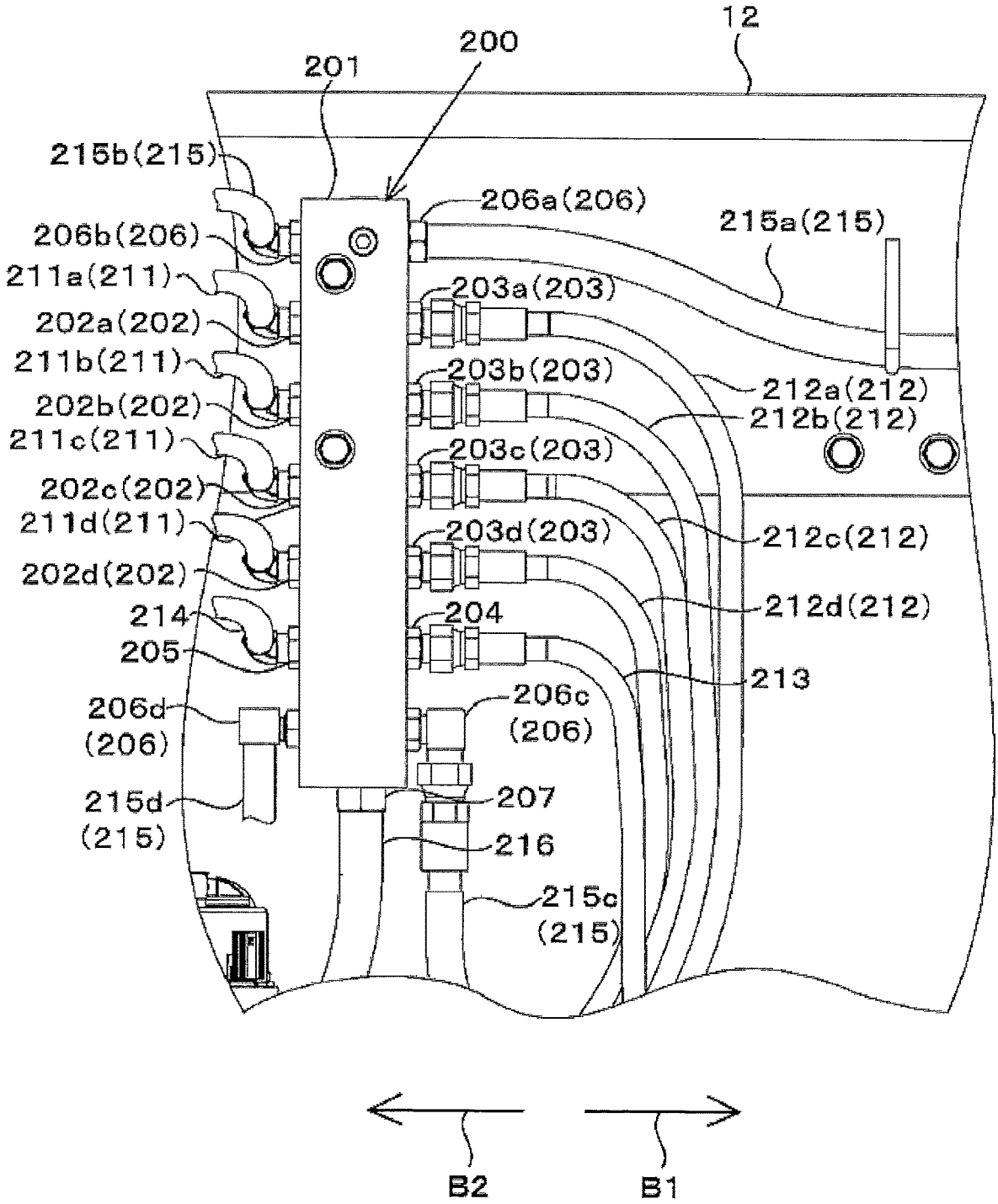
FIG. 4 is an enlarged front view illustrating the machine body, a plurality of first pipe members, a plurality of second pipe members, a plurality of third pipe members, a fourth pipe member, a first drain pipe member, a second drain pipe member, and the relay member, for example.

As illustrated in FIGS. 1, 2A, and 2B, the hydraulic system can be roughly divided into a travel-relating hydraulic system 40A and a work-relating hydraulic system 40B. First, the travel-relating hydraulic system 40A will be described.

As illustrated in FIG. 1, the travel-relating hydraulic system 40A is a system configured to mainly drive travel motors 55.

The travel motors 55 include a left travel motor device (first travel motor device) 55L and a right travel motor device (second travel motor device) 55R. As illustrated in FIG. 1, the travel-relating hydraulic system 40A includes a first hydraulic pump (hydraulic pump) P1, a brake switching valve 151, a brake mechanism 152, a direction switching valve 153, and a hydraulic device 154.

The first hydraulic pump P1 is a pump configured to be driven by power of a drive device 73, and is formed based on a fixed-displacement type gear pump. The first hydraulic pump P1 is configured to supply hydraulic oil stored in a hydraulic oil tank 84. In particular, the first hydraulic pump P1 drains the hydraulic oil mainly used for control. For convenience of description, the hydraulic oil drained from the first hydraulic pump P1 and used for control is also referred to as pilot oil, and pressure of the pilot oil is also referred to as pilot pressure.

On a drain side of the first hydraulic pump P1, a drain oil path 140 configured to allow the hydraulic oil (the pilot oil) to flow is provided. The drain oil path 140 is coupled with a plurality of switching valves. The plurality of switching valves include the brake switching valve 151, the direction switching valve 153, and a hydraulic lock switching valve 155. The drain oil path 140 is provided with a charge oil path 141 bifurcated from the drain oil path 140. The charge oil path 141 is coupled to the hydraulic device 154.

The brake switching valve 151 is coupled to a drain side of the drain oil path 140, from which the hydraulic oil is drained. The brake switching valve 151 is a direction switching valve (electromagnetic valve) configured to allow the brake mechanism 152 to perform a brake operation and a brake releasing operation, as well as is a two-position switching valve configured to switch, through excitation, between a first position 151*a* and a second position 151*b*. The brake switching valve 151 is to be switched with an operation member, for example (not illustrated).

The brake mechanism 152 includes a first brake mechanism 152L configured to perform a brake control on one of the traveling devices 5, which is provided on the left side, and a second brake mechanism 152R configured to perform a brake control on another one of the traveling devices 5, which is provided on the right side. The first brake mechanism 152L and the second brake mechanism 152R are coupled to the brake switching valve 151 via an oil path 145.

The first brake mechanism 152L and the second brake mechanism 152R change respective operation states in accordance with the pressure of the pilot oil (hydraulic oil) to control how degree the traveling devices 5 are braked. Depending on how much the first hydraulic pump P1 drains the pilot oil (hydraulic oil), the first brake mechanism 152L and the second brake mechanism 152R respectively change to an operation state for braking the travel motors 55 or a non-operation state for releasing braking.

When the brake switching valve 151 is put into the first position 151*a*, the hydraulic oil drains from a section, between the brake switching valve 151 and the brake mechanism 152, of the oil path 145. The brake mechanism 152 can therefore perform braking. When the brake switching valve 151 is put into the second position 151*b*, the brake mechanism 152 can release braking. The brake mechanism 152 may release braking when the brake switching valve 151 is put into the first position 151*a*. The brake mechanism 152 may perform braking when the brake switching valve 151 is put into the second position 151*b*.

The direction switching valve 153 is an electromagnetic valve configured to change rotation of the first travel motor device 55L and the second travel motor device 55R, and is a two-position switching valve configured to switch, through excitation, between a first position 153*a* and a second position 153*b*. The direction switching valve 153 is to be switched with an operation member, for example (not illustrated). The direction switching valve 153 may not be a two-position switching valve, but may be a proportional valve configured to adjust an amount of the hydraulic oil to be drained.

The first travel motor device 55L is a motor configured to transmit power to a drive shaft of one of the traveling devices 5, which is provided on the left side of the machine body 2. The second travel motor device 55R is a motor configured to transmit power to a drive shaft of another one of the traveling devices 5, which is provided on the right side of the machine body 2. The second travel motor device 55R operates in a similar manner to the first travel motor device 55L. The second travel motor device 55R is similar in configuration and actuation to the first travel motor device 55L, and thus description for the second travel motor device 55R will be omitted.

The first travel motor device 55L includes an HST motor 156, a swash plate switching cylinder 157, and a travel control valve (hydraulic switching valve) 158A. The HST motor 156 is a swash-plate variable-displacement axial motor capable of changing a vehicle speed (rotation) to a first speed or a second speed.

The swash plate switching cylinder 157 is a cylinder configured to change, through extension and contraction, an angle of a swash plate of the HST motor 156. The travel control valve 158A is a valve configured to allow the swash plate switching cylinder 157 to extend and contract toward a side or another side, and is a two-position switching valve configured to switch between a first position 158*a* and a second position 158*b*. The travel control valve 158A is to be switched by the direction switching valve 153 lying upstream of and coupled to the travel control valve 158A. Specifically, the direction switching valve 153 and the travel control valve 158A are coupled with each other via an oil path 142. The travel control valve 158A is to be thus switched by the hydraulic oil flowing into the oil path 142.

With the first travel motor device 55L described above, the pilot oil drains from a section between the direction switching valve 153 and the travel control valve 158A when the operation member is operated to put the direction switching valve 153 into the first position 153*a*. The travel control valve 158A is thus put into the first position 158*a*. As a result, the swash plate switching cylinder 157 contracts. The HST motor 156 is then put into a state of the first speed. When the operation member is operated to put the direction switching valve 153 into the second position 153*b*, the pilot oil is supplied, via the direction switching valve 153, to the travel control valve 158A. The travel control valve 158A is thus put into the second position 158*b*. As a result, the swash plate switching cylinder 157 extends. The HST motor 156 is then put into a state of the second speed.

As illustrated in FIGS. 1 and 2A, the hydraulic lock switching valve 155 is a two-position switching valve switchable between a first position 155*a* and a second position 155*b*. The hydraulic lock switching valve 155 is coupled to an oil path 143 coupled to pilot valves 185A, 185B, 185C, and 185D. When the hydraulic lock switching valve 155 is at the first position 155*a*, the hydraulic oil (pilot oil) in the oil path 143 drains to a drain part such as the hydraulic oil tank 84. No pilot oil is therefore supplied to the pilot valves 185A, 185B, 185C, and 185D. When the hydraulic lock switching valve 155 is at the second position 155*b*, the pilot oil in the drain oil path 140 is supplied to the oil path 143. The pilot oil in the oil path 143 can therefore flow into the pilot valves 185A, 185B, 185C, and 185D.

The hydraulic system of the work machine 1 is coupled with a warming-up oil path 144. The warming-up oil path 144 is an oil path configured to allow the pilot oil to flow from the plurality of switching valves (the brake switching valve 151, the direction switching valve 153, and the hydraulic lock switching valve 155) to the drain part such as the hydraulic oil tank 84 to perform warming up.

For example, the warming-up oil path 144 is coupled to drain ports of the plurality of switching valves (the brake switching valve 151, the direction switching valve 153, and the hydraulic lock switching valve 155). That is, when the brake switching valve 151 is at the first position 151*a*, the hydraulic oil drains from a section, between the brake switching valve 151 and the brake mechanism 152, of the oil path 145 to the warming-up oil path 144. When the direction switching valve 153 is at the first position 153*a*, the pilot oil in the oil path 142 drains to the warming-up oil path 144. When the hydraulic lock switching valve 155 is at the first position 155*a*, the pilot oil in the oil path 143 drains to the warming-up oil path 144. The warming-up oil path 144 is coupled to a drain oil path 147 configured to drain the hydraulic oil.

The hydraulic device 154 is a device configured to drive the first travel motor device 55L and the second travel motor device 55R, and includes a drive circuit (left drive circuit) 154L configured to drive the first travel motor device 55L and a drive circuit (right drive circuit) 154R configured to drive the second travel motor device 55R.

The drive circuits 154L and 154R each include an HST pump (a travel hydraulic pump) 163, speed-change oil paths 167*h* and 167*i*, and a second charge oil path 167*j*. The speed-change oil paths 167*h* and 167*i* are oil paths respectively coupling the HST pumps 163 and the HST motors 156. The second charge oil path 167*j* is an oil path coupled to the speed-change oil paths 167*h* and 167*i* to supply the hydraulic oil from the first hydraulic pump P1 to the speed-change oil paths 167*h* and 167*i*.

The HST pump 163 is a swash-plate variable-displacement axial pump configured to be driven by power of the drive device 73. The HST pump 163 includes a pressure receiver 163*a* for forward movement and a pressure receiver 163*b* for backward movement. The pressure receivers 163*a* and 163*b* are each configured to receive the pilot pressure. The pilot pressure acting onto the pressure receiver 163*a* or 163*b* changes an angle of the swash plate. Changing the angle of the swash plate can change an output (an amount of the hydraulic oil to be supplied) of the HST pump 163 and a direction of the hydraulic oil to be supplied.

A travel operation device 160 changes the outputs of the HST pumps 163 and the direction of the hydraulic oil to be supplied. Specifically, a travel lever 164 included in the travel operation device 160 can be used to change the outputs of the HST pumps 163 and the direction of the hydraulic oil to be supplied. The travel operation device 160 will be described herein in detail.

As illustrated in FIG. 1, an oil path 146 bifurcated from the drain oil path 140 is coupled to the travel operation device 160. The travel operation device 160 includes an operation valve 165A for forward traveling, an operation valve 165B for backward traveling, an operation valve 165C for right turning, an operation valve 165D for left turning, and the travel lever 164. The travel operation device 160 further includes first to fourth shuttle valves 165*a*, 165*b*, 165*c*, and 165*d*. The operation valves 165A, 165B, 165C, and 165D are operated with a common lever, i.e., the travel lever 164. In accordance with an operation of the travel lever 164 (operation member), the operation valves 165A, 165B, 165C, and 165D change the pressure of the hydraulic oil and supply the hydraulic oil at the pressure being changed to the pressure receivers 163*a* and 163*b* of the HST pumps 163. In the embodiment, the travel lever 164 is used to operate the operation valves 165A, 165B, 165C, and 165D. However, a plurality of the travel levers 164 may be used. For example, a first travel lever may be arranged on one side (left side) of the driver's seat 6, whereas a second travel lever may be arranged on another side. The two travel levers may be used to operate the operation valves 165A, 165B, 165C, and 165D.

The operation valves 165A, 165B, 165C, and 165D respectively include drain ports (ports). As illustrated in FIG. 1, the drain ports are coupled to an oil path 175. As illustrated in FIG. 2A, the oil path 175 is coupled to the drain oil path 147 configured to drain the hydraulic oil.

The travel lever 164 can be tilted, from a neutral position, in forward and backward directions, width directions orthogonal to the forward and backward directions, and diagonal directions. When the travel lever 164 is tilted, the operation valves 165A, 165B, 165C, and 165D of the travel operation device 160 are operated. As a result, the pilot pressure proportional to an amount of the operation of the travel lever 164 from the neutral position is output from secondary-side ports of the operation valves 165A, 165B, 165C, and 165D.

When the travel lever 164 is tilted forward, the operation valve 165A for forward traveling is operated. The pilot pressure is thus output from the operation valve 165A. The pilot pressure acts from the first shuttle valve 165*a*, via an oil path 171, onto the pressure receiver 163*a* for forward movement of the left drive circuit 154L, as well as acts from the second shuttle valve 165*b*, via an oil path 172, onto the pressure receiver 163*a* for forward movement of the right drive circuit 154R. Output shafts of the HST motors 156 therefore normally rotate (forward-rotate) at a speed proportional to an amount of tilt of the travel lever 164. The work machine 1 thus moves straight forward.

When the travel lever 164 is tilted backward, the operation valve 165B for backward traveling is operated. The pilot pressure is thus output from the operation valve 165B. The pilot pressure acts from the third shuttle valve 165*c*, via an oil path 174, onto the pressure receiver 163*b* for backward movement of the left drive circuit 154L, as well as acts from the fourth shuttle valve 165*d*, via an oil path 173, onto the pressure receiver 163*b* for backward movement of the right drive circuit 154R. The output shafts of the HST motors 156 therefore reverse-rotate (backward-rotate) at a speed proportional to an amount of tilt of the travel lever 164. The work machine 1 thus moves straight backward.

When the travel lever 164 is tilted rightward, the operation valve 165C for right turning is operated. The pilot pressure is thus output from the operation valve 165C. The pilot pressure acts from the first shuttle valve 165*a*, via the oil path 171, onto the pressure receiver 163*a* for forward movement of the left drive circuit 154L, as well acts from the fourth shuttle valve 165*d*, via the oil path 173, onto the pressure receiver 163*b* for backward movement of the right drive circuit 154R. The output shaft of the HST motor 156 on the left side therefore normally rotates, whereas the output shaft of the HST motor 156 on the right side therefore reverse-rotates. The work machine 1 thus makes a right turn.

When the travel lever 164 is tilted leftward, the operation valve 165D for left turning is operated. The pilot pressure is thus output from the operation valve 165D. The pilot pressure acts from the second shuttle valve 165*b*, via the oil path 172, onto the pressure receiver 163*a* for forward movement of the right drive circuit 154R, as well as acts from the third shuttle valve 165*c*, via the oil path 174, onto the pressure receiver 163*b* for backward movement of the left drive circuit 154L. The output shaft of the HST motor 156 on the right side therefore normally rotates, whereas the output shaft of the HST motor 156 on the left side therefore reverse-rotates. The work machine 1 thus makes a left turn.

That is, when the travel lever 164 is tilted diagonally leftward and forward, the work machine 1 moves forward and makes a left turn at a speed corresponding to an angle of tilt of the travel lever 164. When the travel lever 164 is tilted diagonally rightward and forward, the work machine 1 moves forward and makes a right turn at a speed corresponding to an angle of tilt of the travel lever 164. When the travel lever 164 is tilted diagonally leftward and backward, the work machine 1 moves backward and makes a left turn at a speed corresponding to an angle of tilt of the travel lever 164. When the travel lever 164 is tilted diagonally rightward and backward, the work machine 1 moves backward and makes a right turn at a speed corresponding to an angle of tilt of the travel lever 164.

Next, the work-relating hydraulic system 40B will be described. As illustrated in FIG. 2A, the work-relating hydraulic system 40B is a system configured to operate the booms 58, the bucket 59, and an auxiliary attachment, for example, and includes a work-relating hydraulic pump (second hydraulic pump) P2, a plurality of control valves 180, a third hydraulic pump P3, a high-flow valve 181, and a high-flow switching valve 182.

The second hydraulic pump P2 is a pump provided at a position different from a position of the first hydraulic pump P1, and is formed based on a fixed-displacement type gear pump. The second hydraulic pump P2 is configured to supply the hydraulic oil stored in the hydraulic oil tank 84. In particular, the second hydraulic pump P2 supplies the hydraulic oil mainly used to actuate a hydraulic actuator. The third hydraulic pump P3 is a pump provided at a position different from the positions of the first hydraulic pump P1 and the second hydraulic pump P2, and is formed based on a fixed-displacement type gear pump.

On a supply side of the second hydraulic pump P2, a main oil path (oil path) 148 is provided. The main oil path 148 is coupled with the plurality of control valves 180. The control valves 180 are valves configured to use the pilot pressure of the pilot oil to switch a direction of the hydraulic oil to be flowed. The control valves 180 are valves configured to control a hydraulic actuator (a hydraulic instrument). The hydraulic instrument is an instrument for controlling (driving), for example, a hydraulic device such as the booms 58, the bucket 59, a hydraulic crusher, a hydraulic breaker, an angle broom, an earth auger, a pallet folk, a sweeper, a mower, or a snow blower, and is, for example, a hydraulic cylinder or a hydraulic motor.

As illustrated in FIG. 2A, the plurality of control valves 180 include a first control valve 180A, a second control valve 180B, and a third control valve 180C. The first control valve 180A is a valve configured to control the hydraulic actuators (boom cylinders) 62 configured to control the booms 58. The second control valve 180B is a valve configured to control the hydraulic actuators (bucket cylinders) 63 configured to control the bucket 59. The third control valve 180C is a valve configured to control a hydraulic instrument (hydraulic cylinder or hydraulic motor) mounted on an auxiliary attachment such as a hydraulic crusher, a hydraulic breaker, an angle broom, an earth auger, a pallet folk, a sweeper, a mower, or a snow blower.

The first control valve 180A and the second control valve 180B respectively are pilot-type, directly-operated spool type three-position switching valves. The control valves each switch among a neutral position, a first position different from the neutral position, and a second position different from the neutral position and the first position. With the pilot pressure acting onto a pressure receiver 180*a* on a side and a pressure receiver 180*b* on another side, the first control valve 180A switches among the neutral position, the first position different from the neutral position, and the second position different from the neutral position and the first position. With the pilot pressure acting onto a pressure receiver 180*c* on a side and a pressure receiver 180*d* on another side, the second control valve 180B switches among the neutral position, the first position different from the neutral position, and the second position different from the neutral position and the first position.

The first control valve 180A is coupled with the boom cylinders 62 via oil paths. The second control valve 180B is coupled with the bucket cylinders 63 via oil paths.

The booms 58 and the bucket 59 can be operated with an operation lever 184 provided around the driver's seat 6. The operation lever 184 is supported to be tiltable, from a neutral position, in the forward, backward, leftward, rightward, and diagonal directions. When the operation lever 184 is tilted, the plurality of pilot valves (operation valves) 185A, 185B, 185C, and 185D provided below the operation lever 184 can be operated. The pilot valves 185A, 185B, 185C, and 185D and the first hydraulic pump P1 are coupled with each other via the drain oil path 140, the hydraulic lock switching valve 155, and the oil path 143. The pilot valves 185A, 185B, 185C, and 185D include drain ports (ports) coupled to an oil path 195.

As illustrated in FIG. 2A, the plurality of pilot valves (operation valves) 185A, 185B, 185C, 185D and the plurality of control valves 180 are coupled with each other via a plurality of oil paths 191, 192, 193, and 194. Specifically, the pilot valve 185A is coupled to the pressure receiver 180*a* of the first control valve 180A via the oil path 191. The pilot valve 185B is coupled to the pressure receiver 180*b* of the first control valve 180A via the oil path 192. The pilot valve 185C is coupled to the pressure receiver 180*c* of the second control valve 180B via the oil path 193. The pilot valve 185D is coupled to the pressure receiver 180*d* of the second control valve 180B via the oil path 194. Each of the pilot valves 185A, 185B, 185C, and 185D can be set with the pressure of the hydraulic oil to be output in accordance with an operation of the operation lever 184. In other words, the pilot valves 185A, 185B, 185C, and 185D can each adjust the hydraulic oil serving as the pilot oil.

More specifically, when the operation lever 184 is tilted forward, the pilot valve (operation valve) 185A for moving-down is operated. The pilot pressure of the pilot oil to be output from the pilot valve 185A for moving-down is thus set. The pilot pressure acts onto the pressure receiver 180*a* of the first control valve 180A. The boom cylinders 62 contract. The booms 58 thus lower.

When the operation lever 184 is tilted backward, the pilot valve (operation valve) 185B for moving-up is operated. The pilot pressure of the pilot oil to be output from the pilot valve 185B for moving-up is thus set. The pilot pressure acts onto the pressure receiver 180*b* of the first control valve 180A. The boom cylinders 62 extend. The booms 58 thus rise.

When the operation lever 184 is tilted rightward, the pilot valve (operation valve) 185C for bucket-dump is operated. The pilot pressure of the pilot oil to be output from the pilot valve 185C is thus set. The pilot pressure acts onto the pressure receiver 180*c* of the second control valve 180B. The bucket cylinders 63 extend. The bucket 59 thus performs a dumping operation.

When the operation lever 184 is tilted leftward, the pilot valve (operation valve) 185D for bucket-scooping is operated. The pilot pressure of the pilot oil to be output from the pilot valve 185D is thus set. The pilot pressure acts onto the pressure receiver 180*d* of the second control valve 180B. The bucket cylinders 63 contract. The bucket 59 thus performs a scooping operation.

The third control valve 180C is a pilot-type, directly-operated spool type three-position switching valve. The third control valve 180C switches its switching position with the pilot pressure to control a direction, an amount, and pressure of the hydraulic oil heading toward a hydraulic instrument of an auxiliary attachment. Specifically, oil paths (supply oil paths) 196 and 197 are coupled between the third control valve 180C and the coupling member 50 coupling the hydraulic instrument. The oil path 196 is coupled with a relief path 196*a* provided with a first relief valve. The hydraulic oil is thus to be drained. The oil path 197 is coupled with a relief path 197*a* provided with a relief valve. The hydraulic oil is thus to be drained.

The high-flow valve 181 is a hydraulic switching valve formed based on a pilot-type two-position switching valve. The high-flow valve (hydraulic switching valve) 181 is configured to switch, with the pilot pressure, between two switching positions (a non-increment position 181*a* and a increment position 181*b*). An inlet port of the high-flow valve 181 is coupled with an oil path on a supply side of the third hydraulic pump P3. An outlet port of the high-flow valve 181 is coupled with an oil path (increment oil path) 198 joining the oil path 196 configured to supply the hydraulic oil to a hydraulic instrument of an auxiliary attachment. The high-flow valve 181 includes a drain port (port) coupled to the hydraulic oil tank 84.

The high-flow switching valve 182 is a direction switching valve formed based on an electromagnetic type two-position switching valve coupled to the pressure receiver 181*c* of the high-flow valve 181, and is switchable between an acting position 182*a* allowing the pilot pressure to act onto the pressure receiver 181*c* and a non-acting position 182*b* disallowing the pilot pressure to act onto the pressure receiver 181*c*. The high-flow switching valve 182 includes a drain port (port) coupled to an oil path 183. The oil path 183 is coupled to the drain oil path 147.

When the high-flow switching valve 182 is put into the acting position 182*a*, the pressure (pilot pressure) of the pilot oil supplied from the third hydraulic pump P3 acts onto the pressure receiver 181*c* of the high-flow valve 181. The high-flow valve 181 is thus put into the increment position 181*b*. As a result, the oil supplied from the third hydraulic pump P3 flows into the increment oil path 198. The hydraulic oil in the increment oil path 198 and the hydraulic oil in the oil path 196 are added to each other. The hydraulic oil thus increases in amount.

When the high-flow switching valve 182 is put into the non-acting position 182*b* where the pilot pressure (set pressure) required to move a spool of the high-flow valve 181 is disallowed to act onto the pressure receiver 181*c*, the pilot pressure at or above the set pressure does not act onto the pressure receiver 181*c* of the high-flow valve 181. The high-flow valve 181 is thus put into the non-increment position 181*a* (switched to a non-increment mode).

As illustrated in FIGS. 2A, 2B, 3, and 4, the work machine 1 includes a relay member 200 (a heat exchanger 200) configured to relay a plurality of pipe members such as pipes and hoses when the pipe members are coupled. The relay member 200 is coupled with a plurality of first pipe members 211. As illustrated in FIGS. 2A and 2B, the plurality of first pipe members 211 are respectively coupled to the plurality of pilot valves 185A, 185B, 185C, and 185D to allow the hydraulic oil output from the plurality of pilot valves 185A, 185B, 185C, and 185D to flow. Among the plurality of first pipe members 211, an end of a first pipe member 211*a* (a part 211*a* of a first pilot oil supply pipe) configured to allow the hydraulic oil output from the pilot valve 185A to flow is coupled to an outlet port 185A1 of the pilot valve 185A. Among the plurality of first pipe members 211, an end of a first pipe member 211*b* (a part 211*b* of a second pilot oil supply pipe) configured to allow the hydraulic oil output from the pilot valve 185B to flow is coupled to an outlet port 185B1 of the pilot valve 185B. Among the plurality of first pipe members 211, an end of a first pipe member 211*c* (a part 211*c* of an additional pilot oil supply pipe) configured to allow the hydraulic oil output from the pilot valve 185C to flow is coupled to an outlet port 185C1 of the pilot valve 185C. Among the plurality of first pipe members 211, an end of a first pipe member 211*d* (a part 211*d* of another additional pilot oil supply pipe) configured to allow the hydraulic oil output from the pilot valve 185D to flow is coupled to an outlet port 185D1 of the pilot valve 185D. Other ends of the first pipe members 211*a* to 211*d* are coupled to the relay member 200.

The relay member 200 is coupled with a plurality of second pipe members 212. The plurality of second pipe members 212 are respectively coupled to the pressure receivers 180*a*, 180*b*, 180*c*, and 180*d* (a first pilot port 180*a*, a second pilot port 180*b*, an additional pilot port 180*c*, and another additional pilot port 180*d*) of the plurality of control valves 180A and 180B. Among the plurality of second pipe members 212, an end of a second pipe member 212*a* (a part 212*a* of the first pilot port supply pipe) configured to allow the hydraulic oil to flow to the pressure receiver 180*a* is coupled to the pressure receiver 180*a*. Among the plurality of second pipe members 212, an end of a second pipe member 212*b* (a part 212*b* of the second pilot oil supply pipe) configured to allow the hydraulic oil to flow to the pressure receiver 180*b* is coupled to the pressure receiver 180*b*. Among the plurality of second pipe members 212, an end of a second pipe member 212*c* (a part 212*c* of the additional pilot oil supply pipe) configured to allow the hydraulic oil to flow to the pressure receiver 180*c* is coupled to the pressure receiver 180*c*. Among the plurality of second pipe members 212, an end of a second pipe member 212*d* (a part 212*d* of the other additional pilot oil supply pipe) configured to allow the hydraulic oil to flow to the pressure receiver 180*d* is coupled to the pressure receiver 180*d*. Other ends of the second pipe member 212*a* to 212*d* are respectively coupled to the relay member 200.

The relay member 200 is further coupled with a third pipe member 213, a fourth pipe member 214, a plurality of first drain pipe members 215, and a second drain pipe member 216. The third pipe member 213 allows the hydraulic oil supplied from the first hydraulic pump P1 to flow. Specifically, an end of the third pipe member 213 is coupled to an outlet port of the hydraulic lock switching valve 155, and another end is coupled to the relay member 200.

The fourth pipe member 214 is a pipe member configured to supply the pilot oil flowing in the third pipe member 213 to the plurality of pilot valves 185A, 185B, 185C, and 185D, and is a pipe member distinct from the first pipe member 211. The fourth pipe member 214 bifurcates at a middle position. Bifurcated ends are respectively coupled to an inlet port 185A2 of the pilot valves 185A and 185B and an inlet port 185C2 of the pilot valves 185C and 185D. Another end of the fourth pipe member 214 is coupled to the relay member 200.

The plurality of first drain pipe members 215 are configured to drain the hydraulic oil. Specifically, the plurality of first drain pipe members 215 include a first drain pipe member 215*a* configured to drain the hydraulic oil drained from the travel operation device 160, and a first drain pipe member 215*b* coupled to a drain port 185A3 configured to drain the hydraulic oil drained from the plurality of pilot valves 185A, 185B, 185C, and 185D. The plurality of first drain pipe members 215 further include a first drain pipe member 215*c* configured to drain the pilot oil in the warming-up oil path 144, and a first drain pipe member 215*d* configured to drain the pilot oil drained from the high-flow valve 181 and the high-flow switching valve 182. The plurality of first drain pipe members 215 (the first drain pipe members 215*a* to 215*d*) are coupled to the relay member 200.

The second drain pipe member 216 is configured to return the pilot oil (hydraulic oil) flowing in the plurality of first drain pipe members 215 to the drain part such as the hydraulic oil tank 84. An end of the second drain pipe member 216 is coupled to the drain part. Another end is coupled to the relay member 200.

Figure 5A:
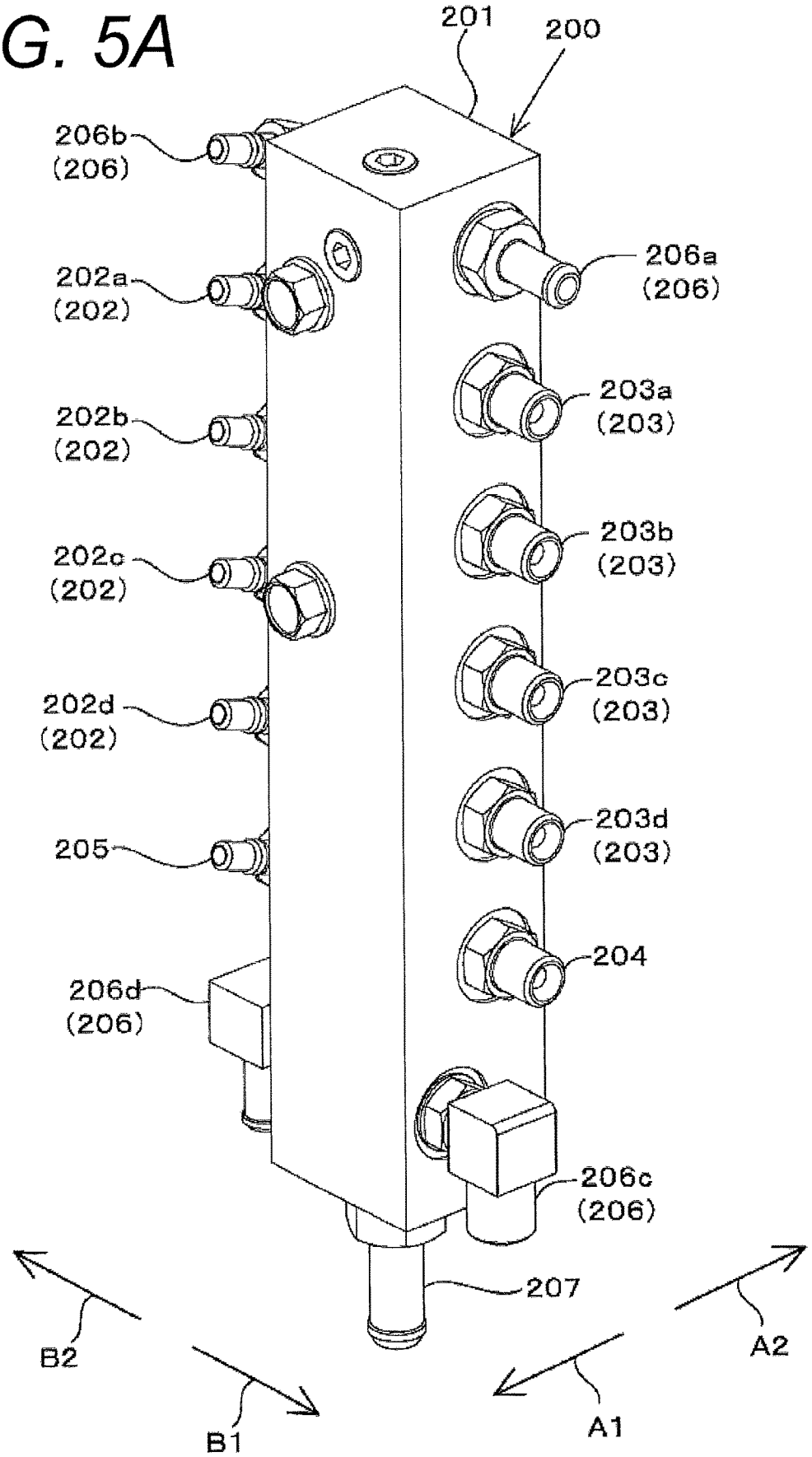
FIG. 5A is a left-front perspective view illustrating the relay member.
Figure 5B:
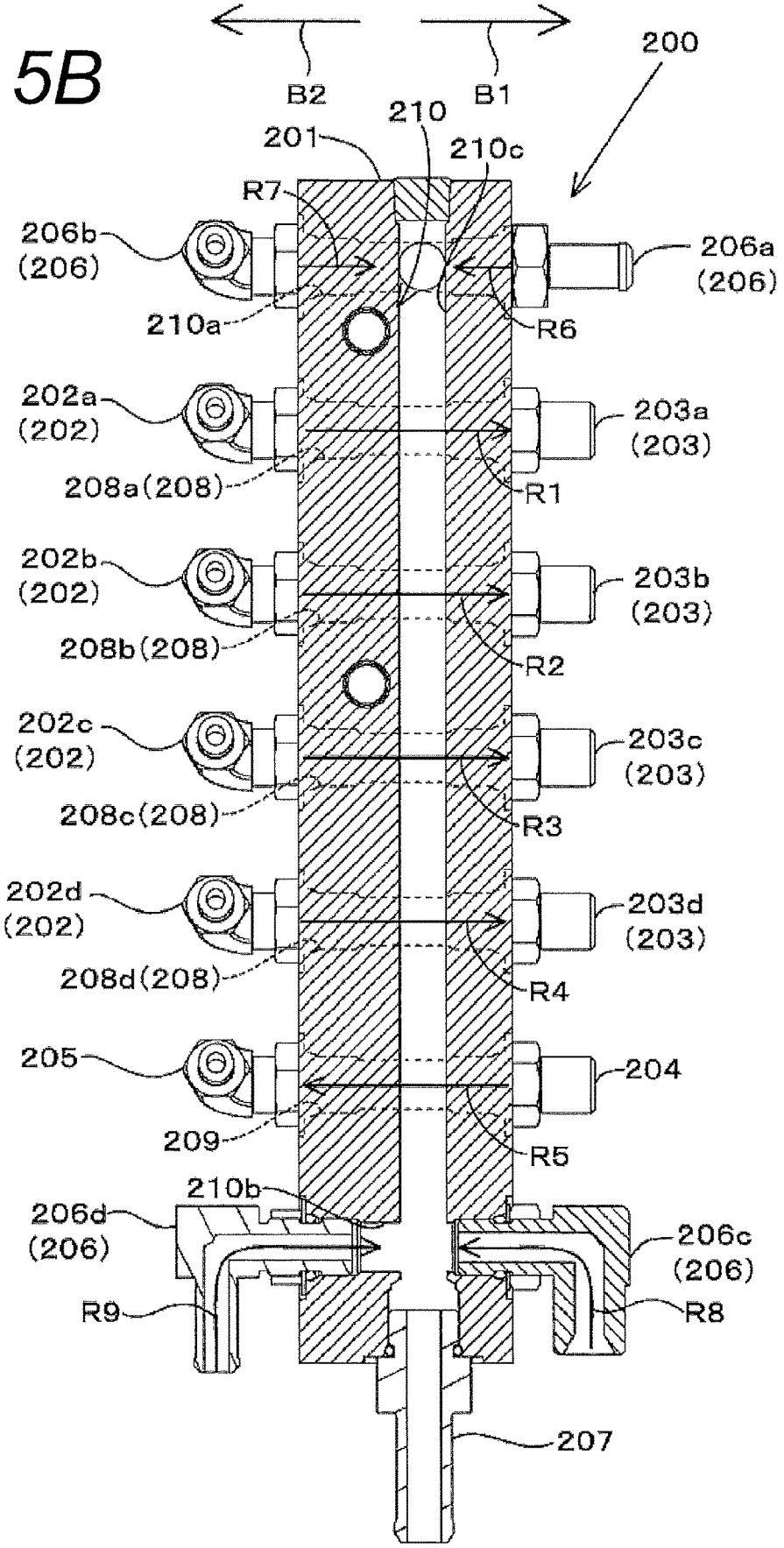
FIG. 5B is a front cross-sectional view illustrating the relay member.
Figure 5C:
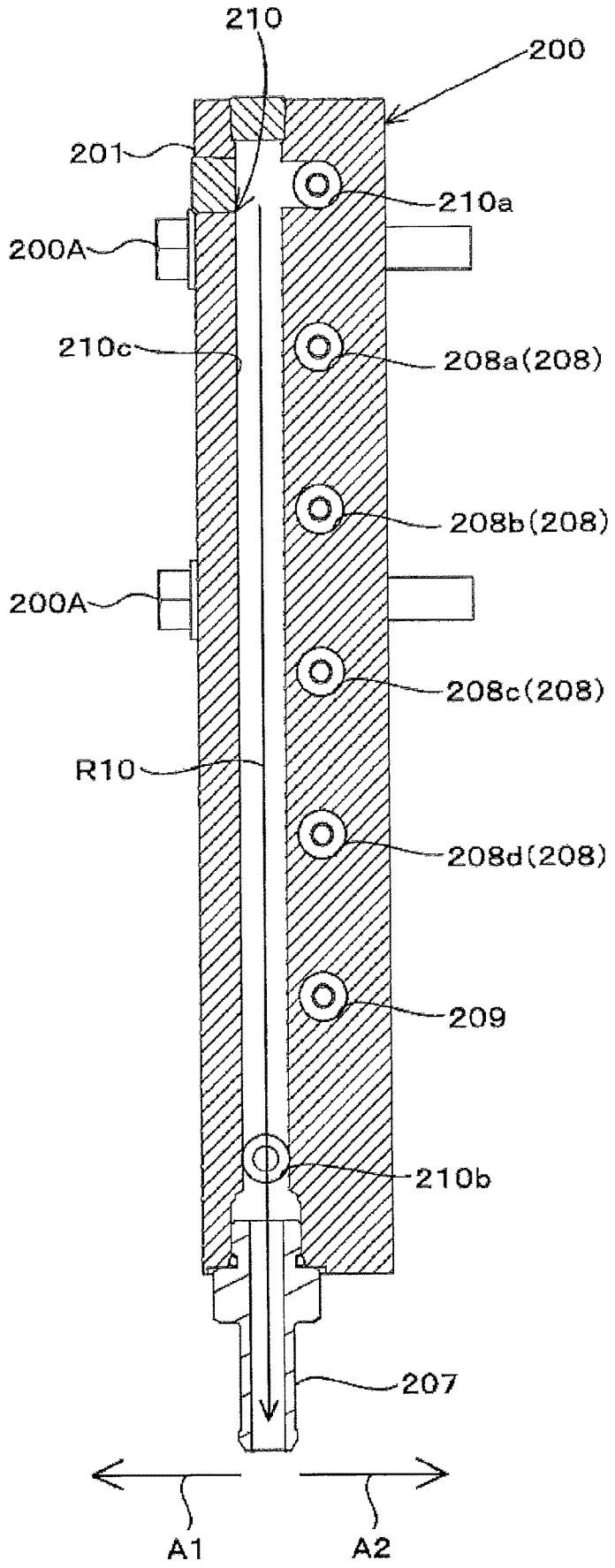
FIG. 5C is a left-side cross-sectional view illustrating the relay member.

The relay member 200 will be described herein in detail with mainly reference to FIGS. 3 to 5C. FIG. 5A is a left-front perspective view of the relay member 200. FIG. 5B is a front cross-sectional view of the relay member 200. FIG. 5C is a left-side cross-sectional view of the relay member 200. In each of FIGS. 5A, 5B, and 5C, the arrow A1 indicates the forward direction, the arrow A2 indicates the backward direction, an arrow B1 indicates the leftward direction, and an arrow B2 indicates the rightward direction. As illustrated in FIGS. 5 and 6, the relay member 200 is attached to an upper frame 12. Specifically, the relay member 200 is arranged on a right side of a front face of the upper frame 12. The relay member 200 is secured to the front face of the upper frame 12 with fastening members 200A such as bolts. The relay member 200 is made of a metallic material with superior thermal conductivity, such as aluminum and steel. The relay member 200 includes a main body 201, a plurality of inlet ports 202, a plurality of outlet ports 203, a first supply port 204, a second supply port 205, and a plurality of first drain ports 206.

As illustrated in FIGS. 3 to 5C, the main body 201 of the relay member 200 is a joint member having a substantially rectangular shape where a length in the upper-lower direction is longer than each of a length in the front-rear direction and a length of the width direction.

The plurality of inlet ports 202 are respectively provided on a side (right side) in the width direction of the main body 201. The plurality of inlet ports 202 are provided on the main body 201 to align in the upper-lower direction. The plurality of inlet ports 202 are respectively coupled with the plurality of first pipe members 211. Specifically, the plurality of inlet ports 202 include an inlet port 202*a* coupled with the first pipe member 211*a* and an inlet port 202*b* coupled with the first pipe member 211*b*. The plurality of inlet ports 202 further include an inlet port 202*c* coupled with the first pipe member 211*c* and an inlet port 202*d* coupled with the first pipe member 211*d*.

The plurality of outlet ports 203 are respectively provided on another side (left side) in the width direction of the main body 201. The plurality of outlet ports 203 are provided on the main body 201 to align in the upper-lower direction. The plurality of outlet ports 203 are respectively coupled with the plurality of second pipe members 212. Specifically, the plurality of outlet ports 203 include an outlet port 203*a* coupled with the second pipe member 212*a* and an outlet port 203*b* coupled with the second pipe member 212*b*. The plurality of outlet ports 203 further include an outlet port 203*c* coupled with the second pipe member 212*c* and an outlet port 203*d* coupled with the second pipe member 212*d*.

The first supply port 204 is provided on the other side (left side) in the width direction of the main body 201. The first supply port 204 is coupled with the third pipe member 213. The second supply port 205 is provided on the side (right side) in the width direction of the main body 201. The second supply port 205 is coupled with the fourth pipe member 214.

The plurality of first drain ports 206 are respectively provided on the side (right side) and the other side (left side) in the width direction of the main body 201. The plurality of first drain ports 206 are respectively coupled with the plurality of first drain pipe members 215. Specifically, the plurality of first drain ports 206 include a first drain port 206*a* coupled with the first drain pipe member 215*a*, a first drain port 206*b* coupled with the first drain pipe member 215*b*, a first drain port 206*c* coupled with the first drain pipe member 215*c*, and a first drain port 206*d* coupled with the first drain pipe member 215*d*. The second drain port 207 is provided at a lower part of the main body 201. The second drain port 207 is coupled with the second drain pipe member 216.

As illustrated in FIGS. 5B and 5C, the relay member 200 includes a plurality of first channels 208, a third channel 209, and a second channel 210. The plurality of first channels 208 are respectively configured to allow the plurality of inlet ports 202 and the plurality of outlet ports 203 to communicate with each other. The plurality of first channels 208 are oil paths formed to align in the upper-lower direction inside the main body 201. The plurality of first channels 208 are provided to extend in the width direction. Specifically, the plurality of first channels 208 include a first channel 208*a* (a part 208*a* of the first pilot oil supply pipe) configured to allow the inlet port 202*a* and the outlet port 203*a* to communicate with each other and a first channel 208*b* (a part 208*b* of the second pilot oil supply pipe) configured to allow the inlet port 202*b* and the outlet port 203*b* to communicate with each other. The plurality of first channels 208 further include a first channel 208*c* (a part 208*c* of the additional pilot oil supply pipe) configured to allow the inlet port 202*c* and the outlet port 203*c* to communicate with each other and a first channel 208*d* (a part 208*d* of the other additional pilot oil supply pipe) configured to allow the inlet port 202*d* and the outlet port 203*d* to communicate with each other.

The third channel 209 is configured to allow the first supply port 204 and the second supply port 205 to communicate with each other. The third channel 209 is an oil path formed inside the main body 201. The third channel 209 is provided to extend in the width direction.

The second channel 210 is configured to allow the plurality of first drain ports 206 and the second drain port 207 to communicate with each other. The second channel 210 is an oil path formed inside the main body 201. Specifically, as illustrated in FIG. 5C, the second channel 210 includes a channel 210*a*, a channel 210*b*, and a channel 210*c*. The channel 210*a* is an oil path configured to allow the first drain port 206*a* and the first drain port 206*b* to communicate with each other. The channel 210*a* is formed at an upper part inside the main body 201 to extend in the width direction. The channel 210*b* is an oil path configured to allow the first drain port 206*c* and the first drain port 206*d* to communicate with each other. The channel 210*b* is formed at the lower part inside the main body 201 to extend in the width direction. The channel 210*c* is an oil path configured to allow the channel 210*a*, the channel 210*b*, and the second drain port 207 to communicate with each other. Specifically, the channel 210*c* is formed to extend downward from a middle part of the channel 210*a*, joins the channel 210*b*, and communicates with the second drain port 207. Therefore, the second channel 210 allows the plurality of first drain ports 206 and the second drain port 207 to communicate with each other.

A part of the work-relating hydraulic system 40B described above includes the plurality of first pipe members 211, the plurality of second pipe members 212, the plurality of third pipe members 213, the fourth pipe member 214, the first drain pipe member 215, the second drain pipe member 216, the plurality of inlet ports 202, the plurality of outlet ports 203, the first supply port 204, the second supply port 205, the plurality of first drain ports 206, the second drain port 207, the first channels 208, the third channel 209, and the second channel 210. To describe specifically, as illustrated in FIGS. 2A and 2B, a part of the oil path 191 includes the first pipe member 211*a*, the inlet port 202*a*, the first channel 208*a*, the outlet port 203*a*, and the second pipe member 212*a*. A part of the oil path 192 includes the first pipe member 211*b*, the inlet port 202*b*, the first channel 208*b*, the outlet port 203*b*, and the second pipe member 212*b*. A part of the oil path 193 includes the first pipe member 211*c*, the inlet port 202*c*, the first channel 208*c*, the outlet port 203*c*, and the second pipe member 212*c*. A part of the oil path 194 includes the first pipe member 211*d*, the inlet port 202*d*, the first channel 208*d*, the outlet port 203*d*, and the second pipe member 212*d*. A part of the oil path 143 includes the third pipe member 213, the first supply port 204, the third channel 209, the second supply port 205, and the fourth pipe member 214. A part of the oil path 175 includes the first drain pipe member 215*a* and the first drain port 206*a*. A part of the oil path 195 includes the first drain pipe member 215*b* and the first drain port 206*b*. A part of the oil path 144 includes the first drain pipe member 215*c* and the first drain port 206*c*. A part of the oil path 183 includes the first drain pipe member 215*d* and the first drain port 206*d*. A part of the drain oil path 147 includes the second channel 210, the second drain port 207, and the second drain pipe member 216.

Herein will describe, with mainly reference to FIGS. 5A, 5B, and 5C, a position relationship among the plurality of inlet ports 202, the plurality of outlet ports 203, the first supply port 204, the second supply port 205, the plurality of first drain ports 206, the second drain port 207, the first channels 208, the third channel 209, and the second channel 210.

The plurality of inlet ports 202, the second supply port 205, the first drain port 206*b*, and the first drain port 206*d* are formed to align in the upper-lower direction on the side (right side) of the main body 201.

Specifically, the plurality of inlet ports 202, the second supply port 205, the first drain port 206*b*, and the first drain port 206*d* are arranged from the upper part on the right side of the main body 201 at predetermined intervals in an order of the first drain port 206*b*, the inlet port 202*a*, the inlet port 202*b*, the inlet port 202*c*, the inlet port 202*d*, the second supply port 205, and the first drain port 206*d*.

On the other hand, the plurality of outlet ports 203, the first supply port 204, the first drain port 206*a*, and the first drain port 206*c* are formed to align in the upper-lower direction on the other side (left side) of the main body 201. Specifically, the plurality of outlet ports 203, the first supply port 204, the first drain port 206*a*, and the first drain port 206*c* are arranged from the upper part on the left side of the main body 201 at predetermined intervals in an order of the first drain port 206*a*, the outlet port 203*a*, the outlet port 203*b*, the outlet port 203*c*, the outlet port 203*d*, the first supply port 204, and the first drain port 206*c*.

That is, as illustrated in FIGS. 5A and 5B, the plurality of first channels 208, the third channel 209, the channel 210*a*, and the channel 210*b* are formed to align in the upper-lower direction inside the main body 201. Specifically, the plurality of first channels 208, the third channel 209, the channel 210*a*, and the channel 210*b* are arranged from the upper part inside the main body 201 at predetermined intervals in an order of the channel 210*a*, the first channel 208*a*, the first channel 208*b*, the first channel 208*c*, the first channel 208*d*, the third channel 209, and the channel 210*b*. The plurality of first channels 208 are arranged to align with each other in a single column. The relay member 200 can thus be formed thinner in a direction in which the first channels 208 and the third channel 209 are orthogonal to the second channel 210. Even when the relay member 200 is to be attached to a relatively narrower region, the relay member 200 can therefore be easily attached to the work machine 1.

As illustrated in FIG. 5C, the channel 210*c* is formed, inside the main body 201, in front of the first channels 208, the third channel 209, the channel 210*a*, and the channel 210*b*. The second channel 210 is provided across the plurality of first channels 208 and the third channel 209. More specifically, the second channel 210 is formed, from the upper part of the main body 201 in order, across the first channel 208*a* and the first channel 208*b*, across the first channel 208*b* and the first channel 208*c*, and across the first channel 208*c* and the first channel 208*d*. The channel 210*c* of the second channel 210 is also formed across the first channel 208*d* and the third channel 209. That is, when focused on how the first channels 208*a* to 208*d* are arranged, the channel 210*c* of the second channel 210 is provided to extend in an arrangement direction of the first channels 208*a* to 208*d*. When focused on how the first channel 208*d* and the third channel 209 are arranged, the channel 210*c* of the second channel 210 is also provided to extend in an arrangement direction of the first channel 208*d* and the third channel 209.

As illustrated in FIG. 5B, when how the plurality of first channels 208 and the third channel 209 overlap with the channel 210*c* of the second channel 210 is viewed in a cross section, the channel 210*c* extends in a direction (upper-lower direction) orthogonal to a direction (width direction) in which the plurality of first channels 208 and the third channel 209 are provided and extended.

Next, how the hydraulic oil relating to the relay member 200 flows will be described with mainly reference to FIGS. 5B and 5C. The hydraulic oil output from the pilot valve 185A flows from the outlet port 185A1 of the pilot valve 185A, via the first pipe member 211*a*, into the inlet port 202*a* of the relay member 200. The hydraulic oil flowed into the inlet port 202*a* passes through the first channel 208*a* and flows from the outlet port 203*a* into the second pipe member 212*a* (R1).

The hydraulic oil output from the pilot valve 185B flows from the outlet port 185B1 of the pilot valve 185B, via the first pipe member 211*b*, into the inlet port 202*b* of the relay member 200. The hydraulic oil flowed into the inlet port 202*b* passes through the first channel 208*b* and flows from the outlet port 203*b* into the second pipe member 212*b* (R2).

The hydraulic oil output from the pilot valve 185C flows from the outlet port 185C1 of the pilot valve 185C, via the first pipe member 211*c*, into the inlet port 202*c* of the relay member 200. The hydraulic oil flowed into the inlet port 202*c* passes through the first channel 208*c* and flows from the outlet port 203*c* into the second pipe member 212*c* (R3). The hydraulic oil output from the pilot valve 185D flows from the outlet port 185D1 of the pilot valve 185D, via the first pipe member 211*d*, into the inlet port 202*d* of the relay member 200. The hydraulic oil flowed into the inlet port 202*d* passes through the first channel 208*d* and flows from the outlet port 203*d* into the second pipe member 212*d* (R4). The hydraulic oil supplied from the first hydraulic pump P1 flows, via the third pipe member 213, into the first supply port 204. The hydraulic oil flowed into the first supply port 204 passes through the third channel 209 and flows into the second supply port 205 (R5). The hydraulic oil flowed into the second supply port 205 passes through the fourth pipe member 214 and flows into the inlet ports 185A2 and 185C2.

The hydraulic oil drained from the travel operation device 160 flows, via the first drain pipe member 215*a*, into the first drain port 206*a*. The hydraulic oil flowed into the first drain port 206*a* flows into the channel 210*a* (R6). The hydraulic oil drained from the pilot valves 185A, 185B, 185C, and 185D flows from the drain port 185A3, via the first drain pipe member 215*b*, into the first drain port 206*b*. The hydraulic oil flowed into the first drain port 206*b* flows into the channel 210*a* (the second channel 210) (R7).

Therefore, the hydraulic oil drained from the travel operation device 160 and the hydraulic oil drained from the pilot valves 185A, 185B, 185C, and 185D can flow into the channel 210*a* (the second channel 210). As illustrated in FIG. 5C, the hydraulic oil flowed into the channel 210*a* flows into the channel 210*c* of the second channel 210 downward from the upper part of main body 201 (R10) to exchange heat with the hydraulic oil flowing in the plurality of first channels 208 and the hydraulic oil flowing in the third channel 209. Specifically, the hydraulic oil flowing in the channel 210*c* of the second channel 210 exchanges heat with, in order, the hydraulic oil flowing in the first channel 208*a*, the hydraulic oil flowing in the first channel 208*b*, the hydraulic oil flowing in the first channel 208*c*, the hydraulic oil flowing in the first channel 208*d*, and the hydraulic oil flowing in the third channel 209. When the hydraulic oil is supplied from the pilot valves 185A, 185B, 185C, and 185D to the first channels 208, and when the operation valves 165A, 165B, 165C, and 165D are not operated (while the travel lever 164 is at the neutral position and thus is not operated), the hydraulic oil at relatively low pressure flows into the second channel 210. The hydraulic oil flowing in the second channel 210 and the hydraulic oil flowing in the first channels 208 can therefore exchange heat. After the work machine 1 is started, the hydraulic oil flows at a relatively lesser amount into the oil path configured to drain the hydraulic oil than an amount of the hydraulic oil flowing in the oil path configured to allow the hydraulic oil to flow from the pilot valves 185A, 185B, 185C, and 185D into the pressure receivers 180*a*, 180*b*, 180*c*, and 180*d* of the control valves 180. Even though a further time is required to warm up the oil paths, the hydraulic oil flowing in the first channels 208 and the hydraulic oil flowing in the second channel 210 can exchange heat. The hydraulic oil flowing from the pilot valves 185A, 185B, 185C, and 185D into the pressure receivers 180*a*, 180*b*, 180*c*, and 180*d* of the control valves 180 can therefore warm up the hydraulic oil in the oil path configured to drain the hydraulic oil. The hydraulic oil supplied from the hydraulic pump P1 is relatively higher in temperature than the hydraulic oil flowing in the oil path configured to allow the hydraulic oil to flow from the pilot valves 185A, 185B, 185C, and 185D into the pressure receivers 180*a*, 180*b*, 180*c*, and 180*d* of the control valves 180. Efficiency in exchanging heat among the first channels 208, the third channel 209, and the second channel 210 can therefore be further increased. The relay member 200 is made of a metallic material. The metallic material normally has higher heat conductivity. The hydraulic oil flowing in the second channel 210 can therefore be efficiently heated.

The hydraulic oil in the warming-up oil path 144 flows, via the first drain pipe member 215*c*, into the first drain port 206*c*. The hydraulic oil flowed into the first drain port 206*c* flows into the channel 210*b* (the second channel 210) (R8). The hydraulic oil drained from the high-flow switching valve 182 flows, via the first drain pipe member 215*d*, into the first drain port 206*d*. The hydraulic oil flowed into the first drain port 206*d* flows into the channel 210*b* (the second channel 210) (R9). The hydraulic oil passed through the warming-up oil path 144 and the hydraulic oil drained from the high-flow switching valve 182 can therefore be drained.

Figure 11A:
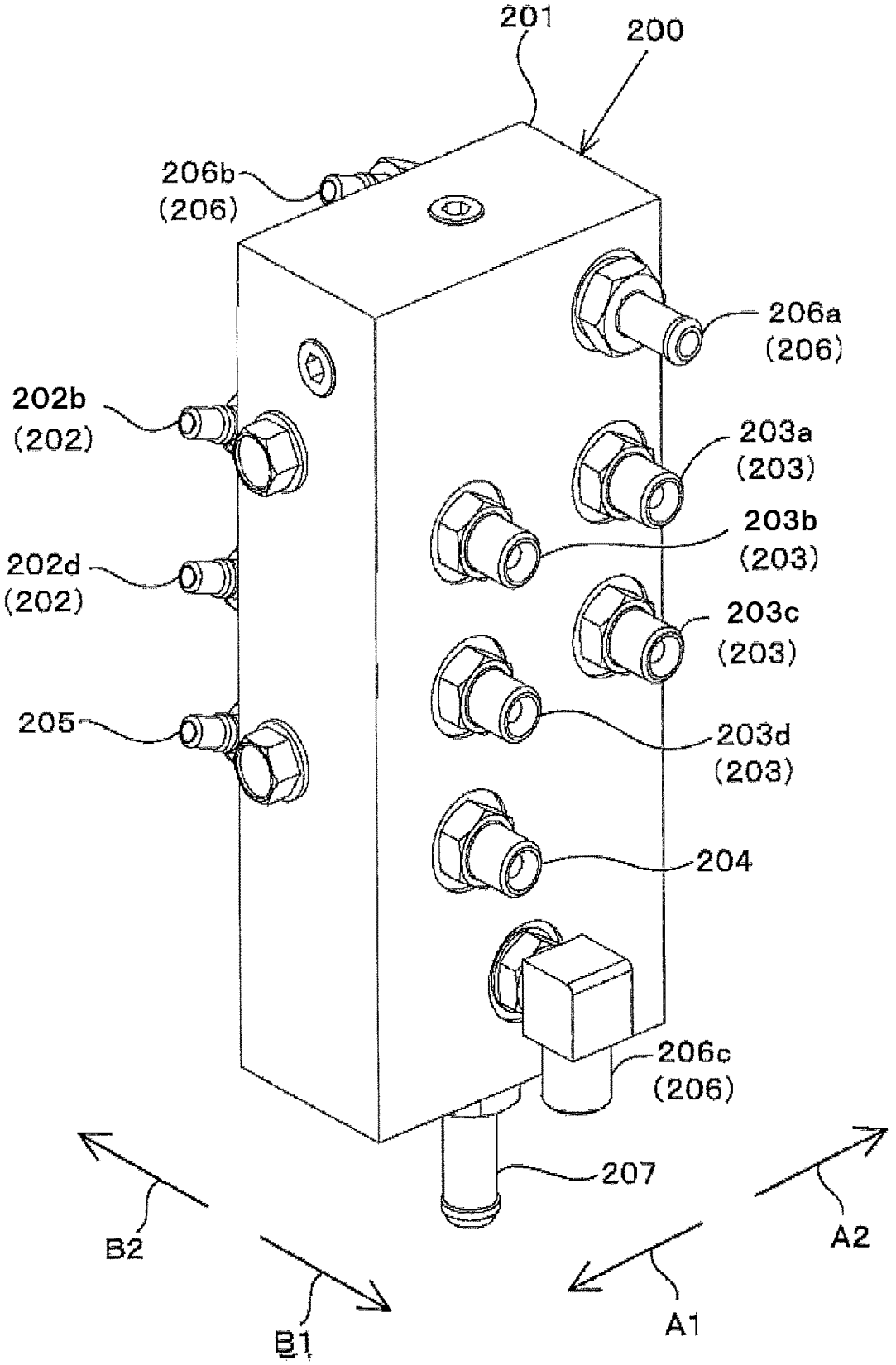
FIG. 11A illustrates an additional modification with respect to the example shown in FIG. 6A.
Figure 11B:
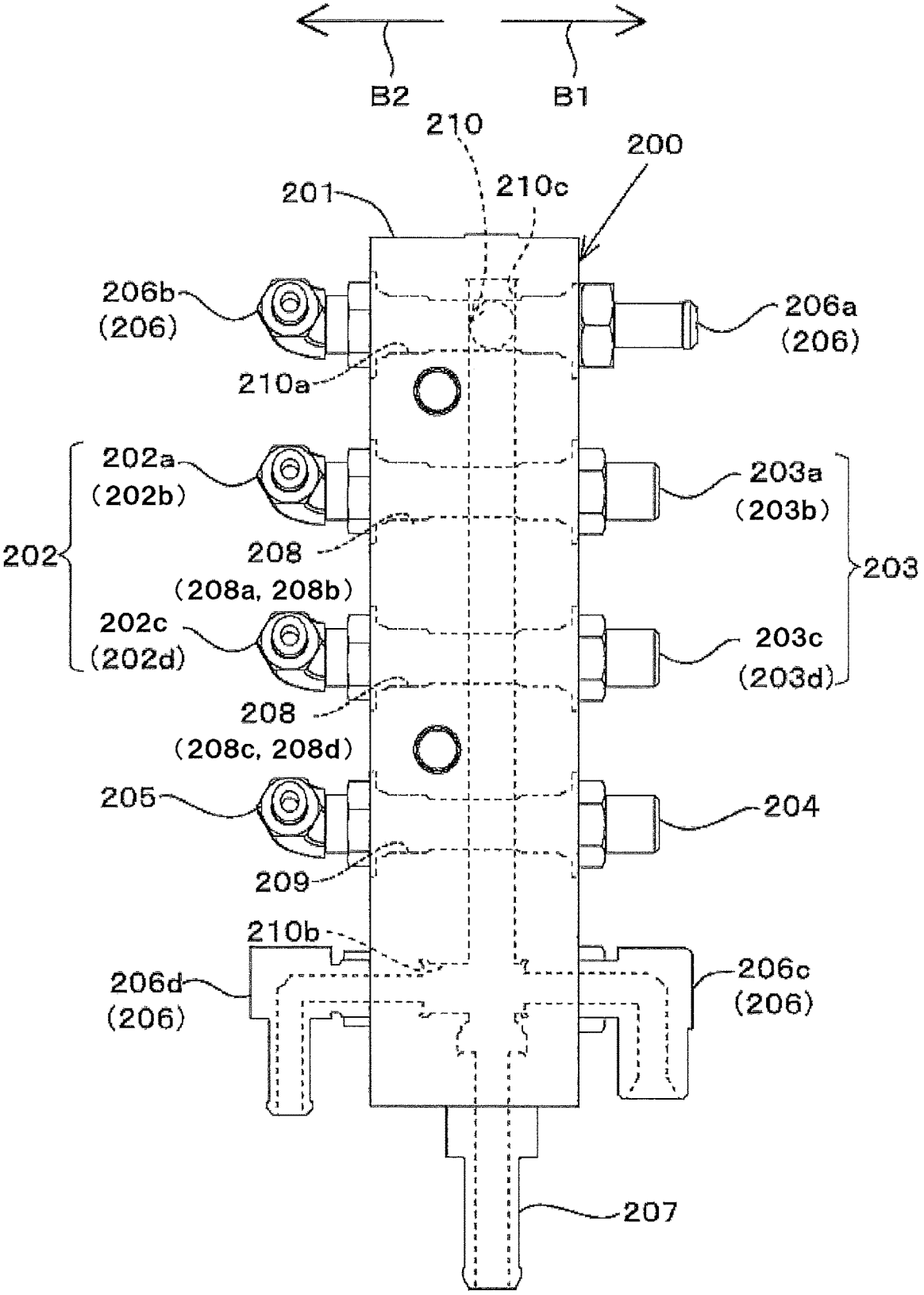
FIG. 11B illustrates an additional modification example with respect to the example shown in FIG. 6B.
Figure 11C:
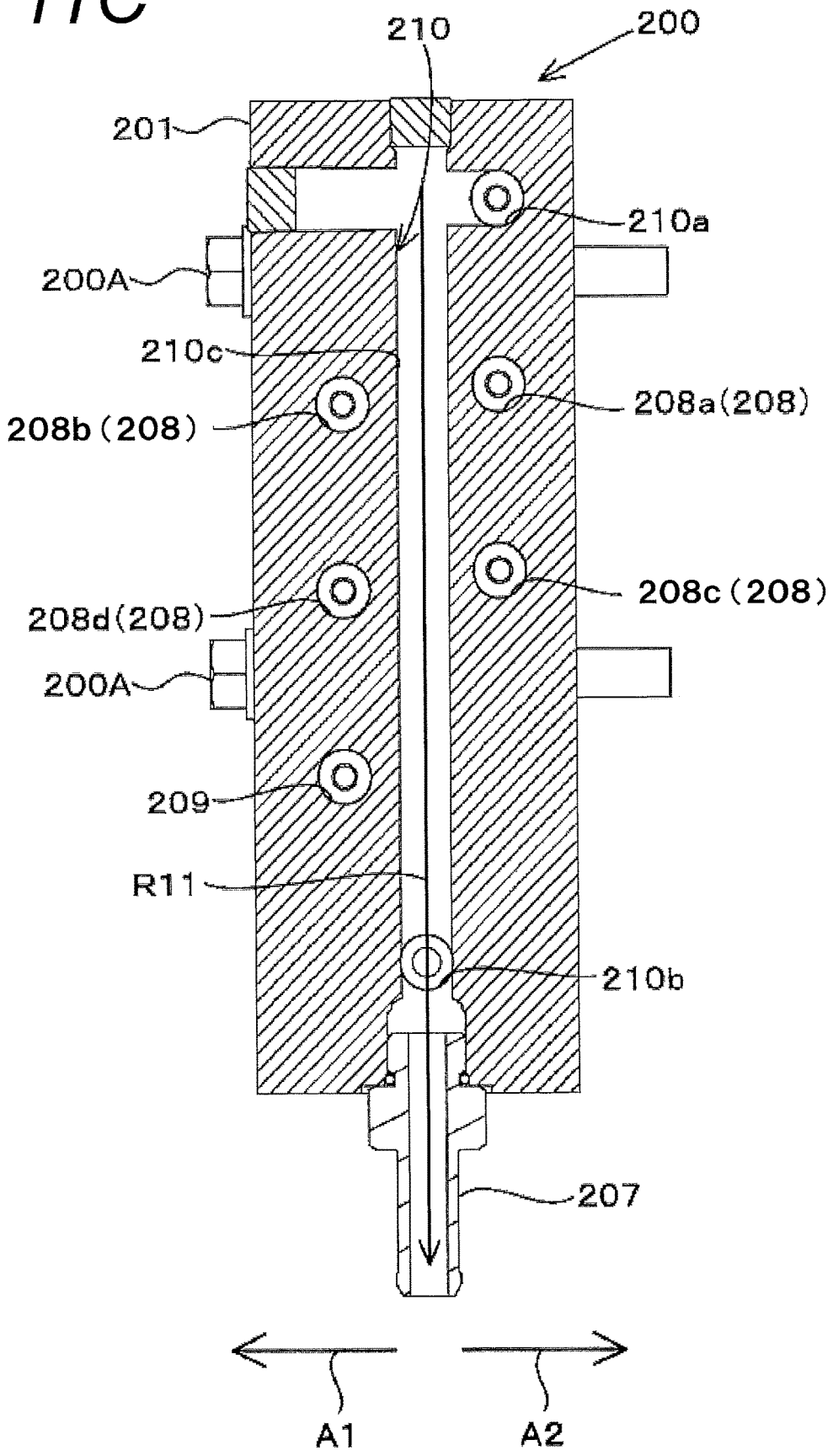
FIG. 11C illustrates an additional modification example with respect to the example shown in FIG. 6C.
Figure 12A:
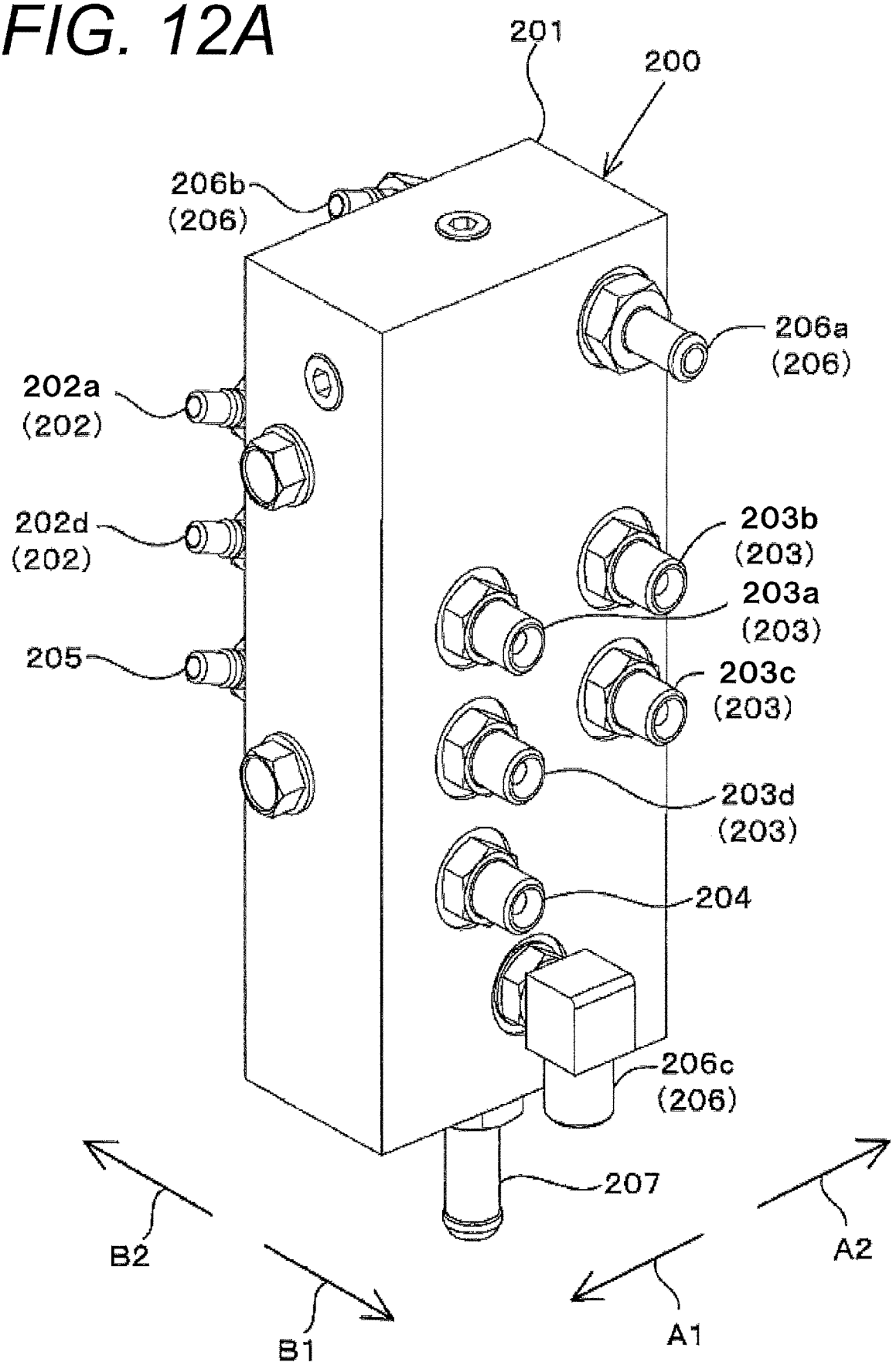
FIG. 12A illustrates an additional modification example with respect to the example shown in FIG. 7A.
Figure 12B:
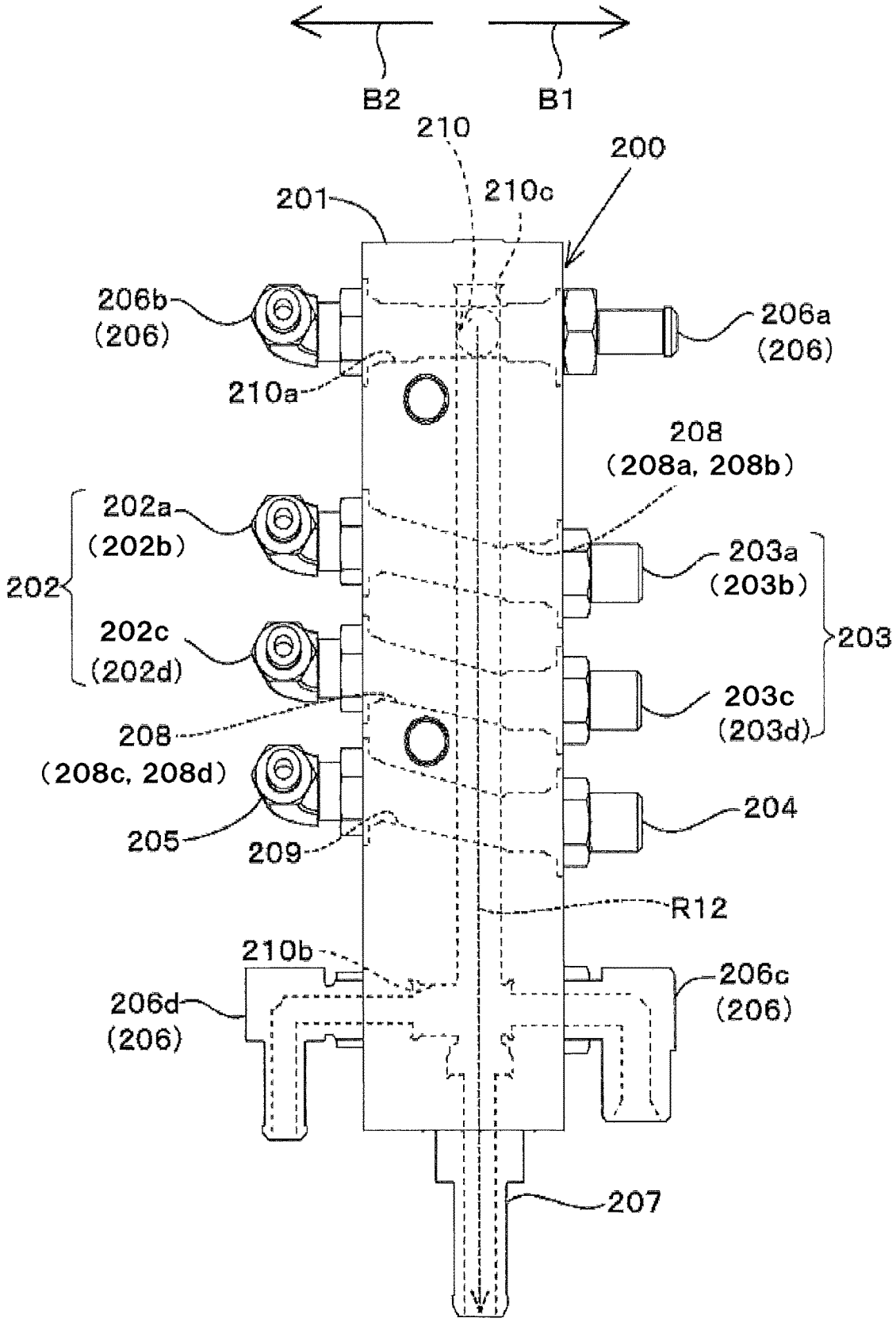
FIG. 12B illustrates an additional modification example with respect to the example shown in FIG. 7B.

In the relay member 200 described above, the plurality of first channels 208 and the third channel 209 are provided on the main body 201 to align with each other. However, the arrangement is not limited to the order described above. Accordingly, examples shown in FIGS. 6A, 6B, 6C, which are explained below, can be modified like examples shown in FIGS. 11A, 11B, and 11C, respectively. Examples shown in FIGS. 7A and 7B, which are explained below, can be modified like examples shown in FIGS. 12A and 12B, respectively. In the embodiment, the relay member 200 is a member relaying the pipe members in the work-relating hydraulic system 40B. However, the identical or similar configuration may be applied to a member relaying pipe members in the travel-relating hydraulic system 40A. In the embodiment, the relay member 200 relays the third pipe member 213 and the fourth pipe member 214. However, such a configuration may be applied that does not relay the third pipe member 213 and the fourth pipe member 214. Furthermore, the present invention is not limited to the configuration described above, as long as, as described in the embodiment, the plurality of first channels 208 and the third channel 209 are provided to align with each other in a single column, and the second channel 210 is provided across the plurality of first channels 208 and the third channel 209.

Figure 6A:
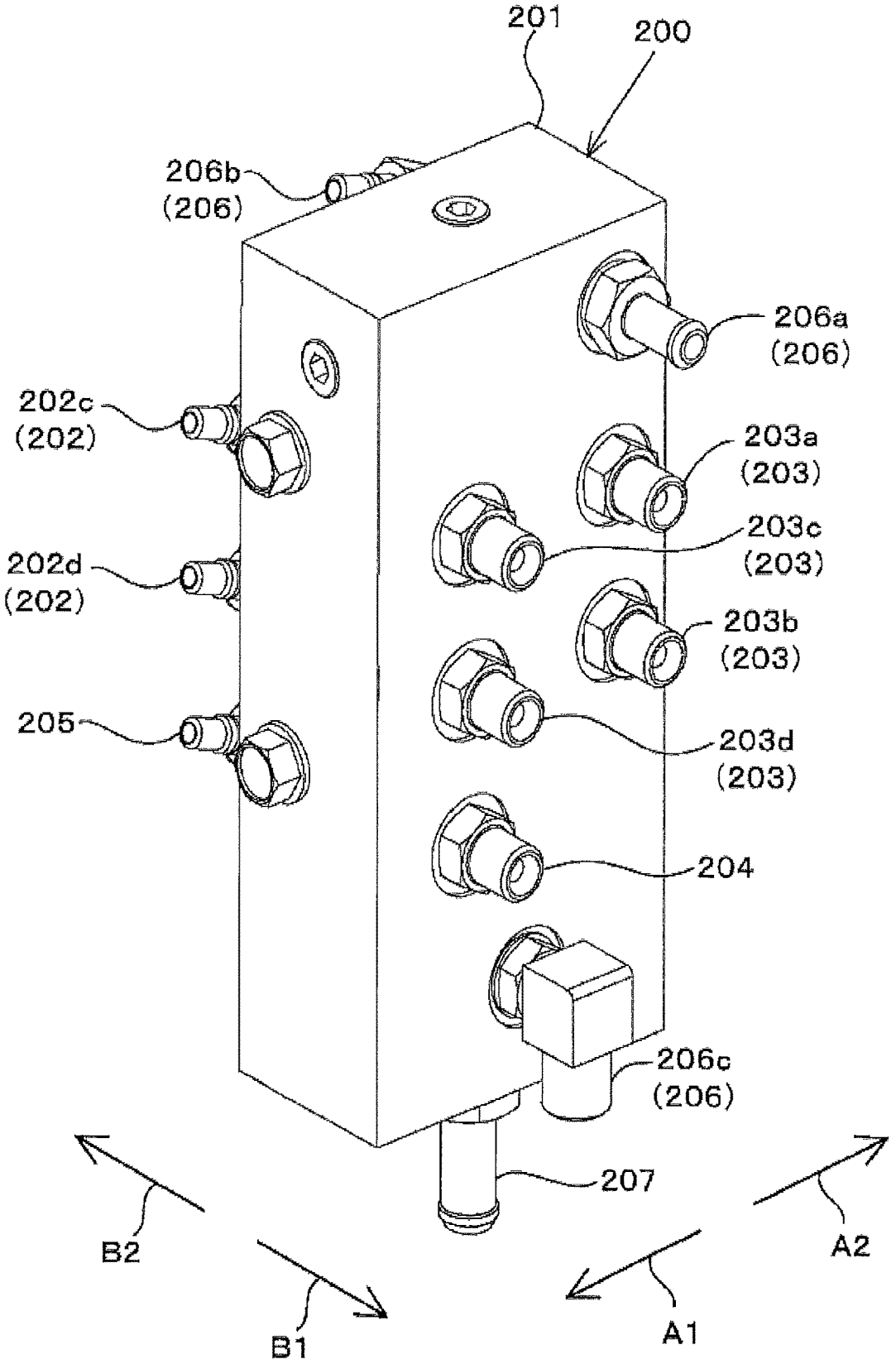
FIG. 6A is a left-front perspective view illustrating a relay member according to a modification example.
Figure 6B:
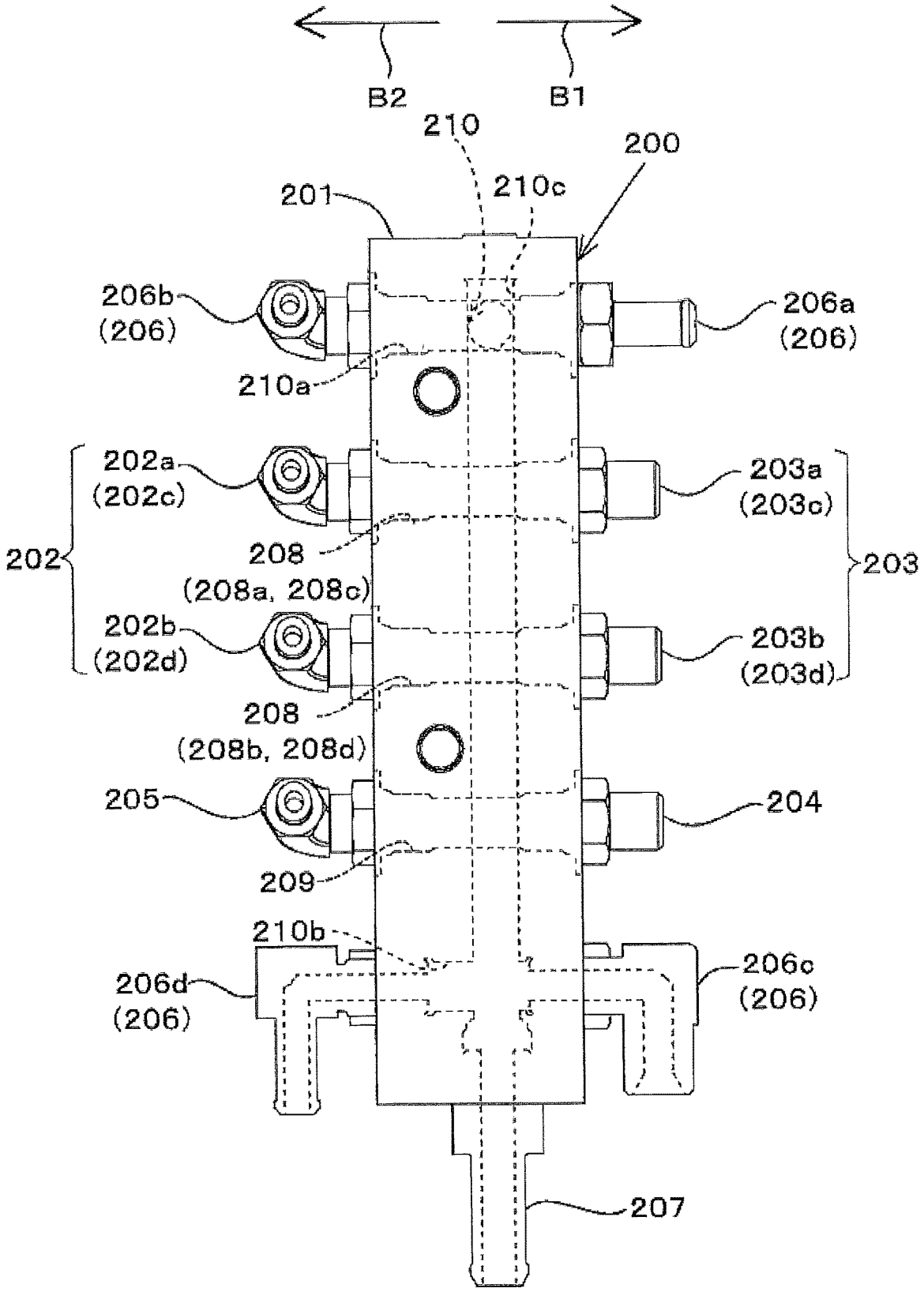
FIG. 6B is a front view illustrating the relay member according to the modification example.
Figure 6C:
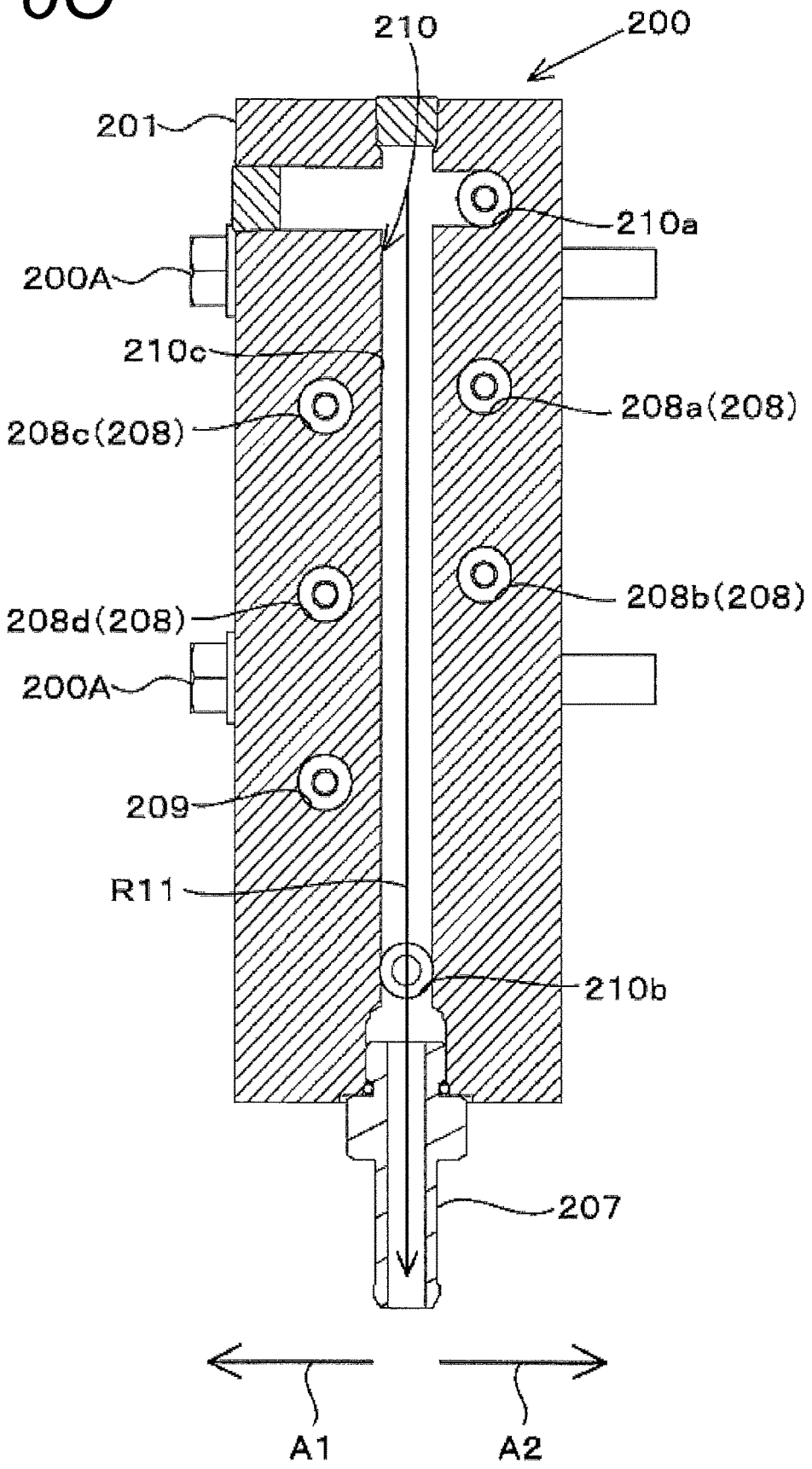
FIG. 6C is a left-side cross-sectional view illustrating the relay member according to the modification example.

Specifically, as illustrated in FIGS. 6A, 6B, and 6C, the plurality of first channels 208 and the third channel 209 may be arranged to align with each other in a plurality of columns, and the second channel 210 may be provided across the plurality of columns to extend in an arrangement direction of the plurality of first channels 208 and the third channel 209. FIG. 6A is a left-front perspective view illustrating the relay member 200 according to a modification example. FIG. 6B is a front view illustrating the relay member 200 according to the modification example. FIG. 6C is a left-side cross-sectional view illustrating the relay member 200 according to the modification example. In FIGS. 6A, 6B, and 6C, the arrow A1 indicates the forward direction, the arrow A2 indicates the backward direction, the arrow B1 indicates the leftward direction, and the arrow B2 indicates the rightward direction. Herein will describe, with mainly reference to FIGS. 6A, 6B, and 6C, a position relationship among the first channels 208, the third channel 209, and the second channel 210 according to the modification example described above.

As illustrated in FIGS. 6B and 6C, the plurality of first channels 208 and the third channel 209 are arranged to align with each other in a plurality of columns. Specifically, the first channel 208*a* and the first channel 208*b* are formed to align in the upper-lower direction on a back part inside the main body 201. More specifically, the first channel 208*a* and the first channel 208*b* are formed away from the upper part of the main body 201 in an order of the first channel 208*a* and the first channel 208*b*. On the other hand, as illustrated in FIG. 6C, the first channel 208*c*, the first channel 208*d*, and the third channel 209 are formed to align in the upper-lower direction on a front part inside the main body 201. More specifically, the first channel 208*c*, the first channel 208*d*, and the third channel 209 are formed away from the upper part of the main body 201 in an order of the first channel 208*c*, the first channel 208*d*, and the third channel 209.

As illustrated in FIG. 6C, the second channel 210 is provided to extend across the plurality of columns. Specifically, the second channel 210 is provided to extend across a column formed by the first channel 208*a* and the first channel 208*b* on a front side inside the main body 201 and a column formed by the first channel 208*c*, the first channel 208*d*, and the third channel 209 on a back side inside the main body 201. The second channel 210 is provided to extend from the upper part to the lower part inside the main body 201. That is, the second channel 210 is provided to extend in the arrangement direction of the plurality of first channels 208 and the third channel 209.

Next, how heat of the hydraulic oil is exchanged in the relay member 200 will be described with mainly reference to FIG. 6C. As illustrated in FIG. 6C, the hydraulic oil flowing in the second channel 210 flows from the upper part to the lower part of the main body 201 (R11) to exchange heat with the hydraulic oil flowing in the plurality of first channels 208 and the hydraulic oil flowing in the third channel 209. Specifically, the hydraulic oil flowing in the second channel 210 first exchanges heat with the hydraulic oil flowing in the first channel 208*a*. Next, the hydraulic oil flowing in the second channel 210 exchanges heat with both the hydraulic oil flowing in the first channel 208*b* and the hydraulic oil flowing in the first channel 208*c*. The hydraulic oil flowing in the second channel 210 further exchanges heat with both the hydraulic oil flowing in the first channel 208*d* and the hydraulic oil flowing in the third channel 209. In other words, the hydraulic oil flowing in the second channel 210 simultaneously exchanges heat with both the hydraulic oil flowing in the channels lying in front of the second channel 210 and the hydraulic oil flowing in the channels lying behind the second channel 210. The hydraulic oil flowing in the second channel 210 can therefore simultaneously exchange heat with both the hydraulic oil flowing in one column of the first channels 208 and the third channel 209 and the hydraulic oil flowing in another one column of the first channels 208. Efficiency in exchanging heat can therefore be further increased. Compared with a case where the first channels 208 and the third channel 209 are arranged in a single column, the relay member 200 can be formed smaller in the arrangement direction of the plurality of first channels 208 and the third channel 209. Even when the relay member 200 is to be attached to a relatively narrower region, the relay member 200 can therefore be easily attached to the work machine 1.

Figure 7A:
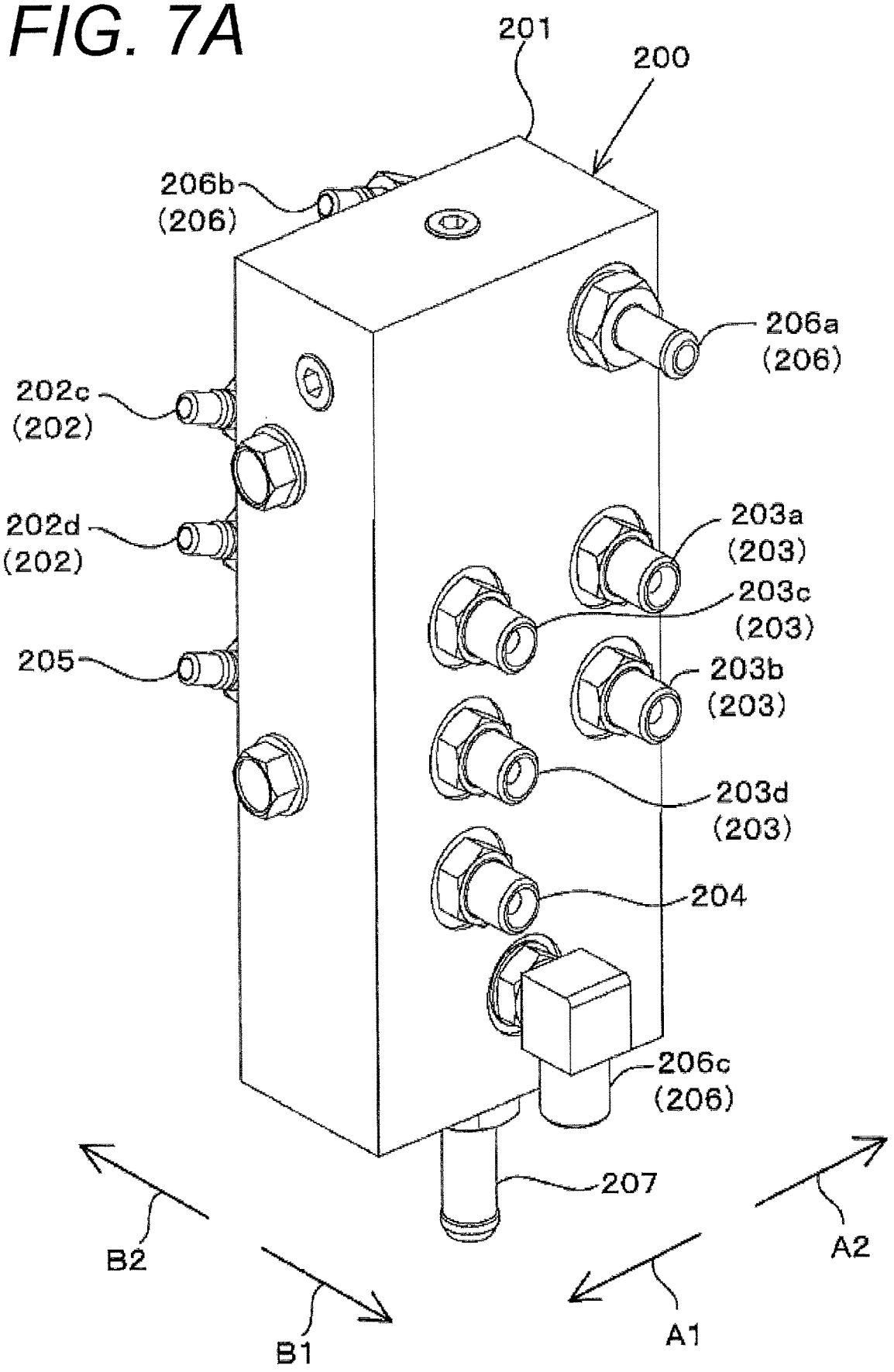
FIG. 7A is a left-front perspective view illustrating a relay member according to a modification example.
Figure 7B:
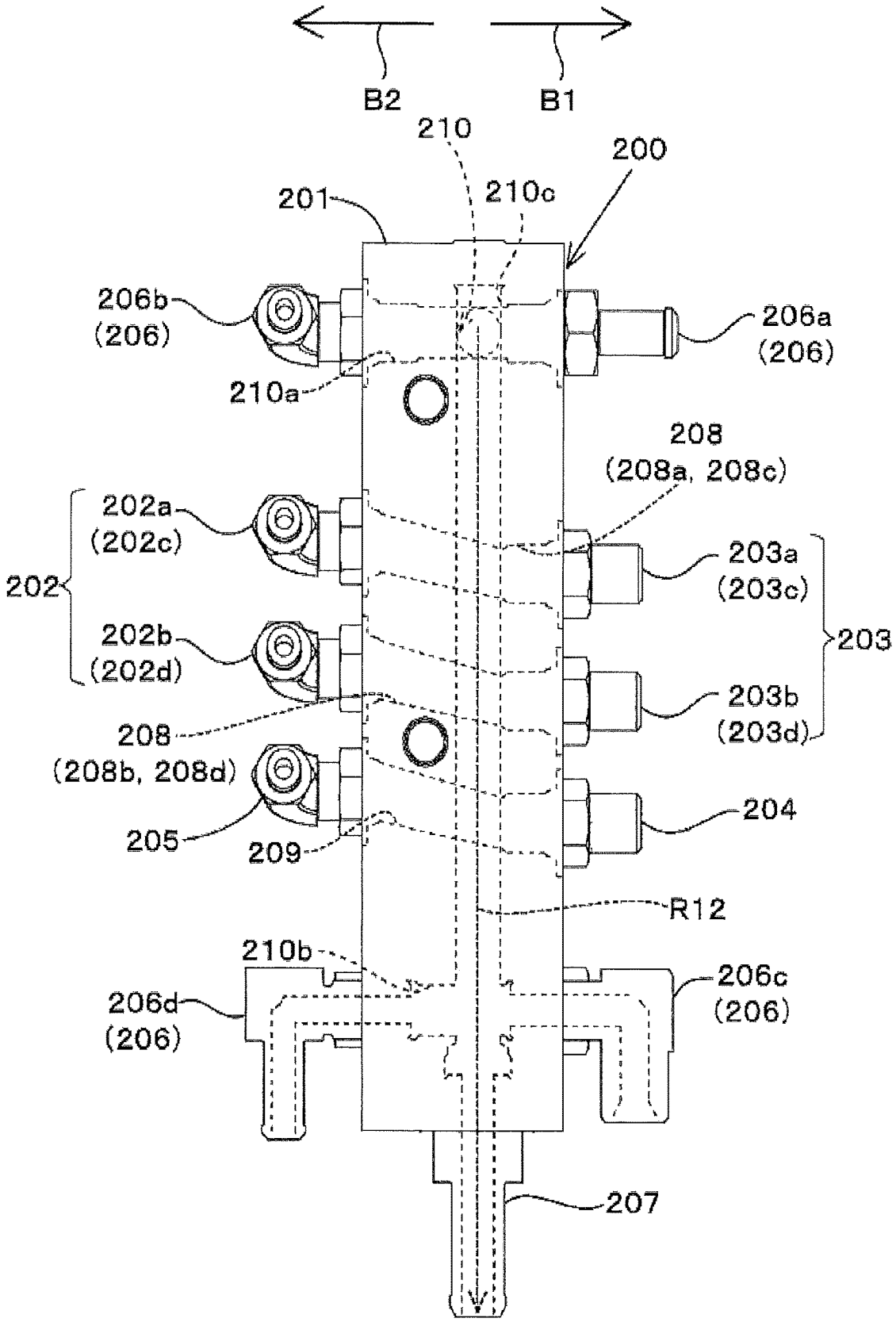
FIG. 7B is a front view illustrating the relay member according to the modification example.

In the embodiment described above, the plurality of first channels 208 and the third channel 209 are provided to extend in the width direction inside the main body 201 and are thus orthogonal to the second channel 210. However, the plurality of first channels 208 and the third channel 209 may be inclined relative to the extending direction (upper-lower direction) of the second channel 210. In other words, the second channel 210 may be provided to extend and incline relative to the extending direction of the plurality of first channels 208 and the third channel 209. A case where the second channel 210 is inclined relative to the extending direction of the plurality of first channels 208 and the third channel 209 will be described herein with mainly reference to FIGS. 7A and 7B. FIG. 7A is a left-front perspective view illustrating the relay member 200 according to a modification example. FIG. 7B is a front view illustrating the relay member 200 according to the modification example. In FIGS. 7A and 7B, the arrow A1 indicates the forward direction, the arrow A2 indicates the backward direction, the arrow B1 indicates the leftward direction, and the arrow B2 indicates the rightward direction.

As illustrated in FIG. 7B, the plurality of first channels 208 and the third channel 209 are inclined downward from one side (left side) to another side (right side). Specifically, the first channel 208*a* and the first channel 208*b* are formed to align in the upper-lower direction on the back part inside the main body 201, and to incline downward from the left side to the right side. More specifically, the first channel 208*a* and the first channel 208*b* are formed away from the upper part of the main body 201 in an order of the first channel 208*a* and the first channel 208*b*. On the other hand, as illustrated in FIG. 7B, the first channel 208*c*, the first channel 208*d*, and the third channel 209 are formed to align in the upper-lower direction on the front part inside the main body 201, and to incline downward from the left side to the right side. More specifically, the first channel 208*c*, the first channel 208*d*, and the third channel 209 are formed away from the upper part of the main body 201 in an order of the first channel 208*c*, the first channel 208*d*, and the third channel 209.

Next, how heat of the hydraulic oil is exchanged in the relay member 200 will be described with mainly reference to FIG. 7B. As illustrated in FIG. 7B, the hydraulic oil flowing in the second channel 210 flows from the upper part to the lower part of the main body 201 (R12) to exchange heat with the hydraulic oil flowing in the plurality of first channels 208 and the hydraulic oil flowing in the third channel 209. Specifically, the hydraulic oil flowing in the second channel 210 first exchanges heat with the hydraulic oil flowing in the first channel 208*a*. Next, the hydraulic oil flowing in the second channel 210 exchanges heat with both the hydraulic oil flowing in the first channel 208*b* and the hydraulic oil flowing in the first channel 208*c*. The hydraulic oil flowing in the second channel 210 further exchanges heat with both the hydraulic oil flowing in the first channel 208*d* and the hydraulic oil flowing in the third channel 209. In other words, the hydraulic oil flowing in the second channel 210 simultaneously exchanges heat with both the hydraulic oil flowing in the channels lying in front of the second channel 210 and the hydraulic oil flowing in the channels lying behind the second channel 210. Compared with a case where the first channels 208 and the third channel 209 are orthogonal to the second channel 210, a region where the first channels 208 and the third channel 209 overlap with the second channel 210 can therefore be fully secured. Efficiency in exchanging heat between the hydraulic oil flowing in the first channels 208 and the third channel 209 and the hydraulic oil flowing in the second channel 210 can therefore be further increased.

Figure 8A:
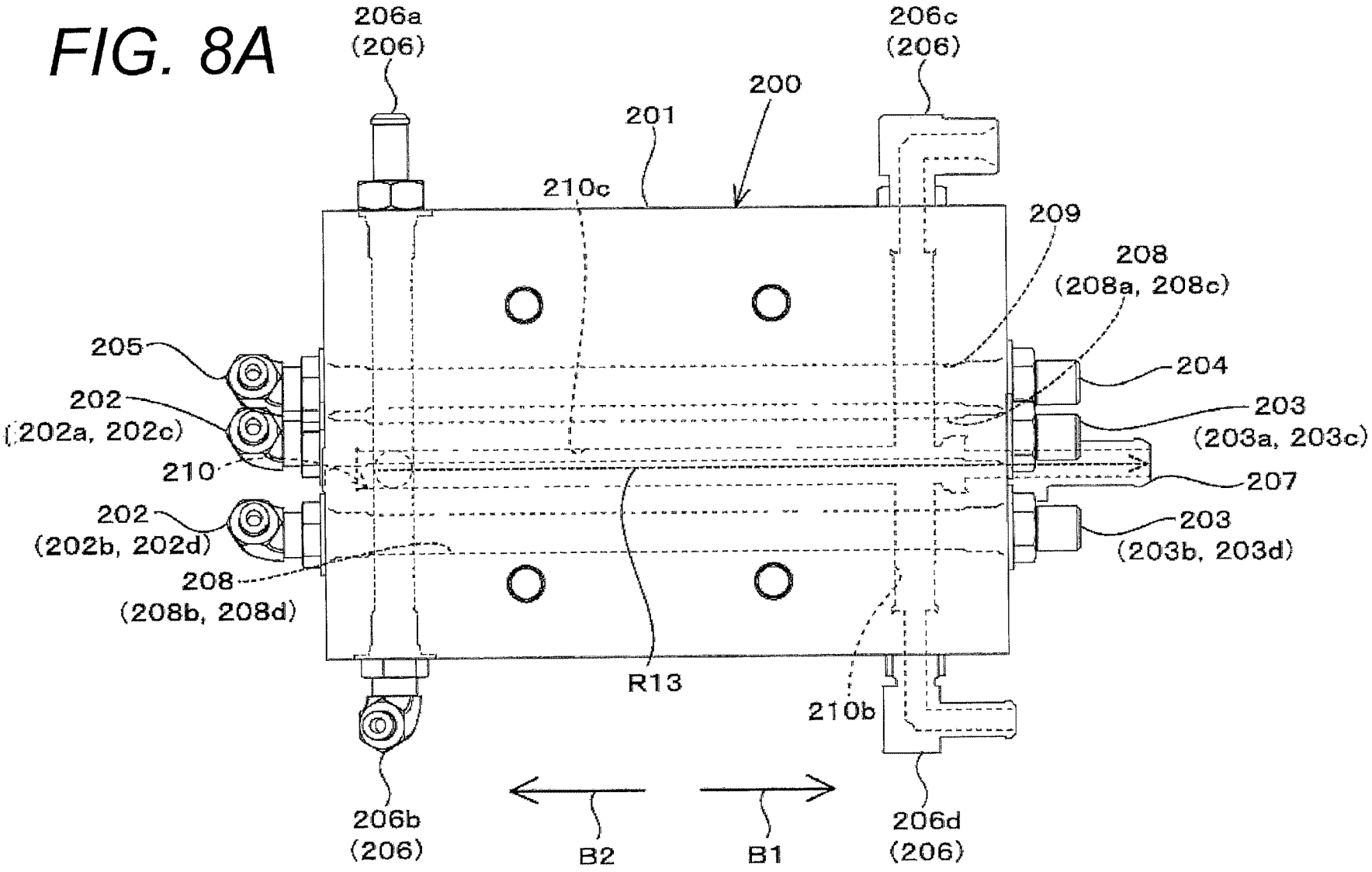
FIG. 8A is a front view illustrating a relay member according to a modification example.
Figure 8B:
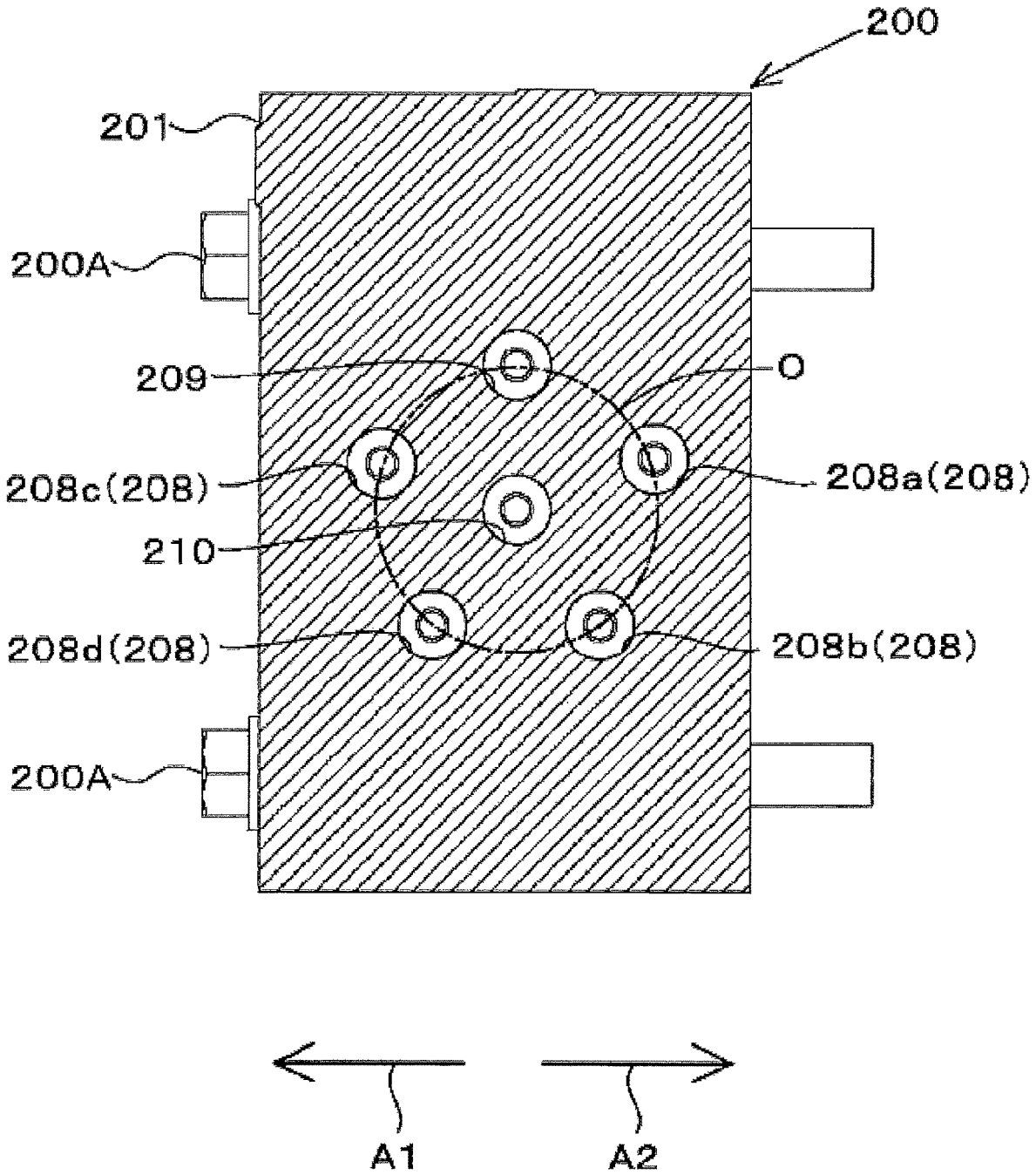
FIG. 8B is a left-side cross-sectional view illustrating the relay member according to the modification example.

The arrangement of the plurality of first channels 208 and the third channel 209 is not limited to the configuration described above. As illustrated in FIG. 8A, the plurality of first channels 208 and the third channel 209 may be arranged around the second channel 210. A case where the second channel 210 is inclined relative to the extending direction of the plurality of first channels 208 and the third channel 209 will be described herein with mainly reference to FIGS. 8A and 8B. FIG. 8A is a front view illustrating the relay member 200 according to a modification example. FIG. 8B is a left-side cross-sectional view illustrating the relay member 200 according to the modification example. In FIGS. 8A and 8B, the arrow A1 indicates the forward direction, the arrow A2 indicates the backward direction, the arrow B1 indicates the leftward direction, and the arrow B2 indicates the rightward direction.

As illustrated in FIG. 8B, the plurality of first channels 208, the third channel 209, and the second channel 210 extend from one side (left side) to another side (right side). Specifically, the second channel 210 is provided to extend from a center on the right side of the main body 201 to a center on the left side of the main body 201. The plurality of first channels 208 and the third channel 209 are arranged around the second channel 210 and provided to extend from the center on the right side of the main body 201 to the center on the left side of the main body 201. Specifically, the first channel 208*a* is arranged in front of and above the second channel 210 and provided to extend from the center on the right side of the main body 201 to the center on the left side of the main body 201. The first channel 208*b* is arranged in front of and below the second channel 210 and provided to extend from the center on the right side of the main body 201 to the center on the left side of the main body 201. The first channel 208*c* is arranged behind and below the second channel 210 and provided to extend from the center on the right side of the main body 201 to the center on the left side of the main body 201. The first channel 208*d* is arranged behind and above the second channel 210 and provided to extend from the center on the right side of the main body 201 to the center on the left side of the main body 201. The third channel 209 is arranged above the second channel 210 and provided to extend from the center on the right side of the main body 201 to the center on the left side of the main body 201. That is, the second channel 210 is arranged inside an inner circumference of a virtual circle O rendered by the plurality of first channels 208 and the third channel 209.

Next, how heat of the hydraulic oil is exchanged in the relay member 200 will be described with mainly reference to FIG. 8B. As illustrated in FIG. 8B, the hydraulic oil flowing in the second channel 210 flows from the right side to the left side of the main body 201 (R13) to exchange heat with the hydraulic oil flowing in the plurality of first channels 208 and the hydraulic oil flowing in the third channel 209. Specifically, the hydraulic oil flowing in the second channel 210 exchanges heat with the hydraulic oil flowing in the first channel 208*a* lying in front of and above the second channel 210 across an area from the right side to the left side of the main body 201. The hydraulic oil flowing in the second channel 210 exchanges heat with the hydraulic oil flowing in the first channel 208*b* lying in front of and below the second channel 210 across an area from the right side to the left side of the main body 201. The hydraulic oil flowing in the second channel 210 exchanges heat with the hydraulic oil flowing in the first channel 208*c* lying behind and below the second channel 210 across an area from the right side to the left side of the main body 201. The hydraulic oil flowing in the second channel 210 exchanges heat with the hydraulic oil flowing in the first channel 208*d* lying behind and above the second channel 210 across an area from the right side to the left side of the main body 201. The hydraulic oil flowing in the second channel 210 exchanges heat with the hydraulic oil flowing in the third channel 209 lying above the second channel 210 across an area from the right side to the left side of the main body 201. In other words, the hydraulic oil flowing in the second channel 210 simultaneously exchanges heat with both the hydraulic oil flowing in the plurality of first channels 208 and the hydraulic oil flowing in the third channel 209 across an area from the one side (left side) to the other side (right side) of the second channel 210 in the relay member 200. Such a region that the first channels 208 and the third channel 209 overlap with the second channel 210, and that the hydraulic oil flowing in the first channels 208 and the third channel 209 warms up the hydraulic oil flowing in the second channel 210 from around the second channel 210 can therefore be fully secured. Efficiency in exchanging heat among the first channels 208, the third channel 209, and the second channel 210 can therefore be further increased.

Figure 9A:
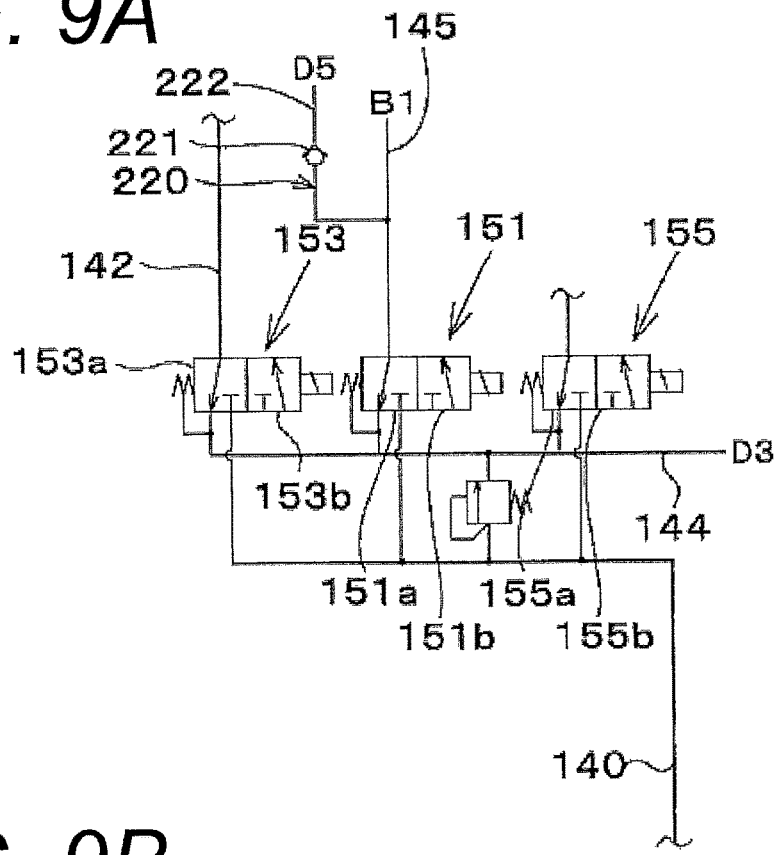
FIG. 9A is an enlarged view of a hydraulic system around a brake switching valve according to a modification example.
Figure 9B:
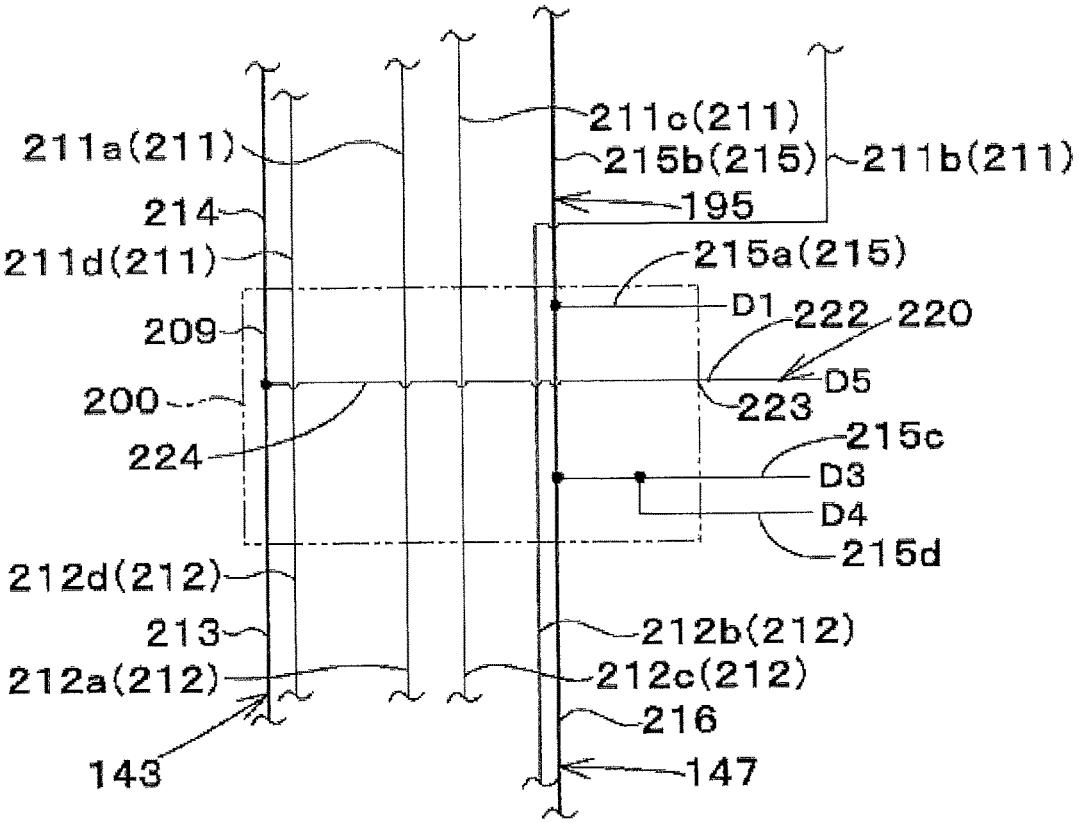
FIG. 9B is an enlarged view of a hydraulic system around a relay member according to the modification example.
Figure 9C:
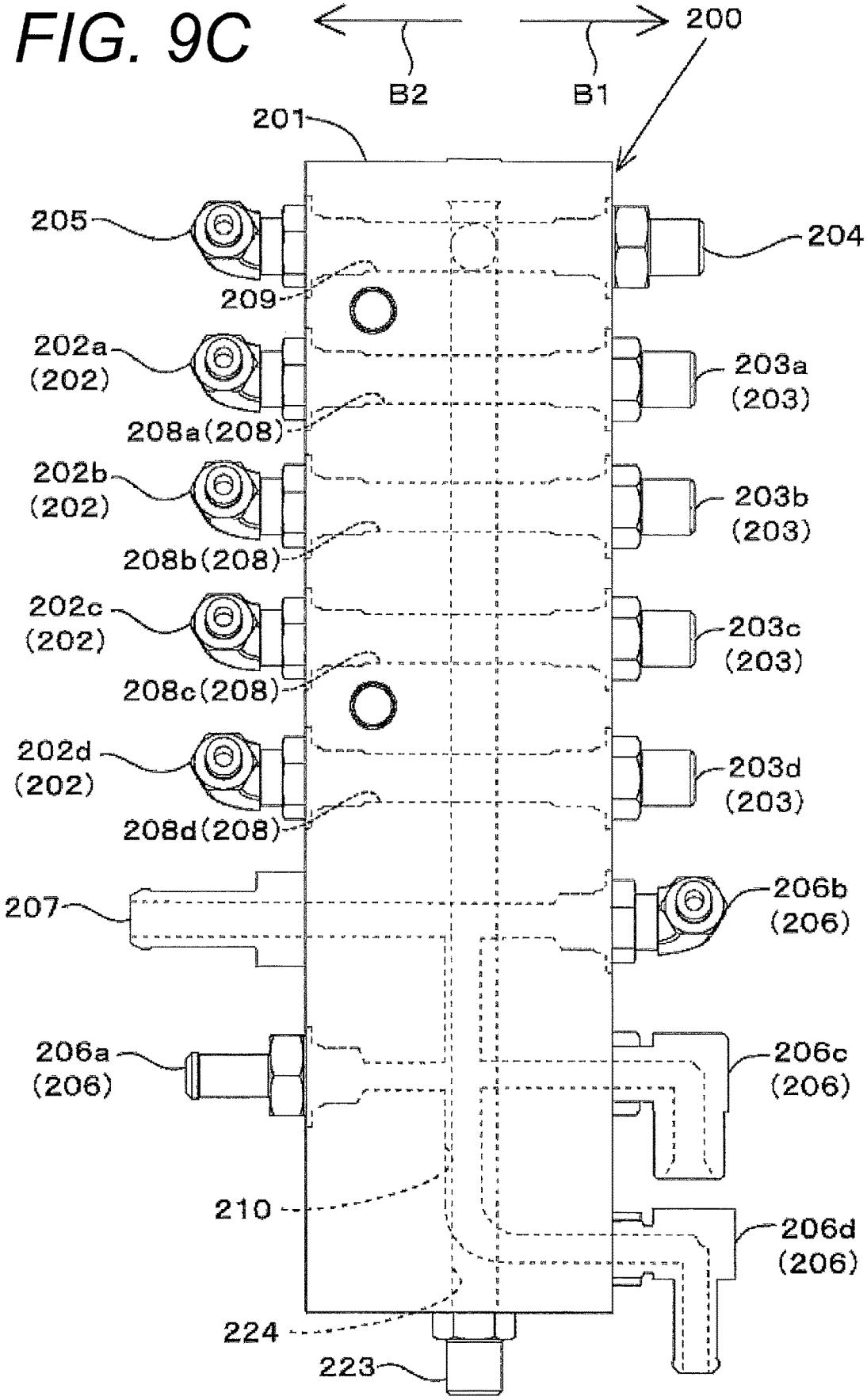
FIG. 9C is a front view illustrating the relay member according to the modification example.

The circuits of the hydraulic systems of the work machine 1 are not limited to have the configurations described above, but may be coupled with a warming-up oil path 220, as illustrated in FIGS. 9A and 9B. FIG. 9A is an enlarged view of a hydraulic system around the brake switching valve 151 according to a modification example. FIG. 9B is an enlarged view of a hydraulic system around the relay member 200 according to the modification example. As illustrated in FIG. 9B, the warming-up oil path 220 is an oil path coupling the oil path 143 and the oil path 145, as well as is an oil path configured to bypass, for warming-up purpose, the pilot oil heading from the oil path 143, via the oil path 145, the warming-up oil path 144, and the hydraulic oil tank 84, for example, toward the pilot valves 185A, 185B, 185C, and 185D. The warming-up oil path 220 is provided with a check valve 221. As illustrated in FIG. 9A, the check valve 221 allows the pilot oil to flow from the oil path 143 to the oil path 145, but disallows the pilot oil to flow from the oil path 145 to the oil path 143. That is, when the brake switching valve 151 is at the first position 151*a*, the pilot oil flowing from the oil path 143, via the warming-up oil path 220, to the oil path 145 passes through the brake switching valve 151 and the warming-up oil path 144, and drains to the hydraulic oil tank 84. As illustrated in FIG. 9C, the warming-up oil path 220 is bifurcated from a middle part of the third channel 209 of the relay member 200 to couple the oil path 143 and the oil path 145. FIG. 9C is a front view illustrating the relay member 200 according to the modification example. In FIG. 9C, the arrow B1 indicates the leftward direction, and the arrow B2 indicates the rightward direction. As illustrated in FIGS. 9B and 9C, a part of the warming-up oil path 220 includes a fifth pipe member 222, a warming-up port 223, and a fourth channel 224 (a branch pipe 224). The fifth pipe member 222 is a pipe member such as a hose or a pipe and configured to couple the check valve 221 and the relay member 200. Specifically, for example, an end of the fifth pipe member 222 is coupled to the check valve 221, whereas another end of the fifth pipe member 222 is coupled to the warming-up port 223. The fifth pipe member 222 is configured to allow the pilot oil to flow from the warming-up port 223 formed on the relay member 200 to the check valve 221. As illustrated in FIG. 9C, the warming-up port 223 is provided on the lower part of the relay member 200, for example. The fourth channel 224 allows the warming-up port 223 and the third channel 209 to communicate with each other. Specifically, for example, the fourth channel 224 is bifurcated from a middle part of the third channel 209. The fourth channel 224 is an oil path formed to extend in the upper-lower direction inside the main body 201.

Herein will describe, with mainly reference to FIG. 9C, a position relationship among the plurality of inlet ports 202, the plurality of outlet ports 203, the first supply port 204, the second supply port 205, the plurality of first drain ports 206, the second drain port 207, the warming-up port 223, the first channels 208, the third channel 209, the second channel 210, and the fourth channel 224. As illustrated in FIG. 9C, different from the configuration described above, the second supply port 205, the plurality of inlet ports 202, the second drain port 207, and the first drain port 206*a* are formed on the side (right side) of the main body 201 to align in the upper-lower direction. Specifically, the second supply port 205, the plurality of inlet ports 202, the second drain port 207, and the first drain port 206*a* are arranged from the upper part on the right side of the main body 201 at predetermined intervals in an order of the second supply port 205, the inlet port 202*a*, the inlet port 202*b*, the inlet port 202*c*, the inlet port 202*d*, the second drain port 207, and the first drain port 206*a*.

On the other hand, the first supply port 204, the plurality of outlet ports 203, the first drain port 206*b*, the first drain port 206*c*, and the first drain port 206*d* are formed to align in the upper-lower direction on the other side (left side) of the main body 201. Specifically, the first supply port 204, the plurality of outlet ports 203, the first drain port 206*b*, the first drain port 206*c*, and the first drain port 206*d* are arranged from the upper part on the left side of the main body 201 at predetermined intervals in an order of the first supply port 204, the outlet port 203*a*, the outlet port 203*b*, the outlet port 203*c*, the outlet port 203*d*, the first drain port 206*b*, the first drain port 206*c*, and the first drain port 206*d*.

That is, as illustrated in FIG. 9C, the third channel 209, the plurality of first channels 208, and the second channel 210 are formed to align in the upper-lower direction inside the main body 201. Specifically, the third channel 209, the plurality of first channels 208, and the second channel 210 are arranged from the upper part inside the main body 201 at predetermined intervals in an order of the third channel 209, the first channel 208*a*, the first channel 208*b*, the first channel 208*c*, the first channel 208*d*, and the second channel 210.

Figure 9D:
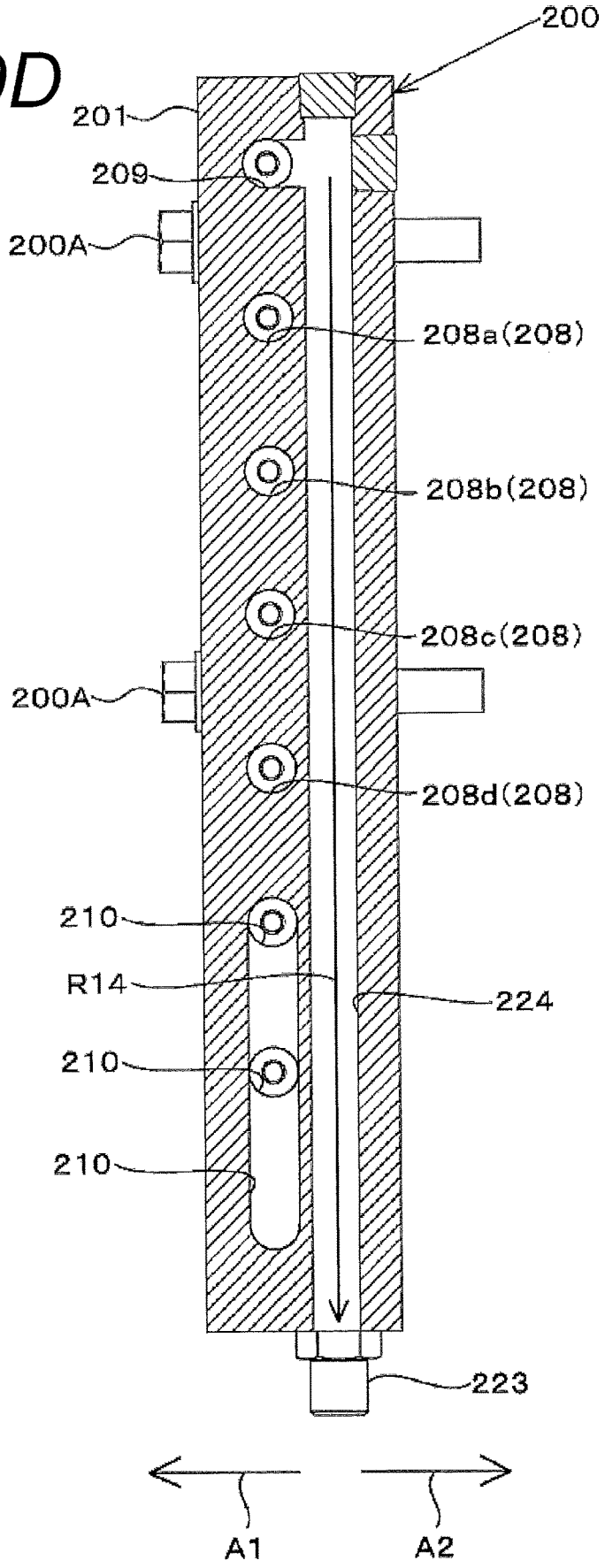
FIG. 9D is a left-side cross-sectional view illustrating the relay member according to the modification example.

As illustrated in FIGS. 9C and 9D, the fourth channel 224 is provided across the plurality of columns (the plurality of first channels 208 and the second channel 210). FIG. 9D is a left-side cross-sectional view illustrating the relay member 200 according to the modification example. In FIG. 9C, the arrow A1 indicates the forward direction, and the arrow A2 indicates the backward direction. Specifically, the fourth channel 224 is provided on the back part of the main body 201 to extend in an arrangement direction of the third channel 209, the plurality of first channels 208, and the second channel 210. The fourth channel 224 is formed behind the third channel 209, the plurality of first channels 208, and the second channel 210.

Next, how heat of the hydraulic oil is exchanged in the relay member 200 will be described with mainly reference to FIG. 9C. As illustrated in FIG. 9C, the hydraulic oil flowing in the fourth channel 224 flows from the upper part to the lower part of the main body 201 (R14) to exchange heat with the hydraulic oil flowing in the plurality of first channels 208 and the hydraulic oil flowing in the second channel 210. Specifically, the hydraulic oil flowing in the fourth channel 224 first exchanges heat with the hydraulic oil flowing in the first channel 208*a*. Next, the hydraulic oil flowing in the fourth channel 224 exchanges heat with both the hydraulic oil flowing in the first channel 208*b* and the hydraulic oil flowing in the first channel 208*c*. The hydraulic oil flowing in the fourth channel 224 further exchanges heat with both the hydraulic oil flowing in the first channel 208*d* and the hydraulic oil flowing in the second channel 210. The hydraulic oil supplied from the hydraulic pump P1 can therefore exchange heat across the third channel 209, the first channels 208, and the second channel 210 due to its relatively higher temperature than a temperature of the hydraulic oil flowing in the oil path configured to allow the hydraulic oil to flow from the pilot valves 185A, 185B, 185C, and 185D into the pressure receivers 180*a*, 180*b*, 180*c*, and 180*d* of the control valves 180. The hydraulic oil supplied from the hydraulic pump P1 can therefore warm up the hydraulic oil flowing from the pilot valves 185A, 185B, 185C, and 185D into the pressure receivers 180*a*, 180*b*, 180*c*, and 180*d* of the control valves 180 and the hydraulic oil in the oil path configured to drain the hydraulic oil.

The work machine 1 described above includes the hydraulic actuators 62 and 63 each configured to be driven by the hydraulic oil, the plurality of control valves 180 configured to control the hydraulic actuators 62 and 63, the plurality of pilot valves 185A, 185B, 185C, and 185D configured to adjust the hydraulic oil serving as the pilot oil, the plurality of first pipe members 211 respectively coupled to the plurality of pilot valves 185A, 185B, 185C, and 185D and configured to allow the pilot oil output from the plurality of pilot valves 185A, 185B, 185C, and 185D to flow, the plurality of second pipe members 212 respectively coupled to the pressure receivers 180*a*, 180*b*, 180*c*, and 180*d* of the plurality of control valves 180, the first drain pipe member 215 configured to drain the hydraulic oil, the second drain pipe member 216 configured to return the hydraulic oil to the drain part configured to drain the hydraulic oil, and the relay member 200 including the plurality of inlet ports 202 coupled with the plurality of first pipe members 211, the plurality of outlet ports 203 coupled with the plurality of second pipe members 212, the plurality of first channels 208 configured to allow the plurality of inlet ports 202 and the plurality of outlet ports 203 to respectively communicate with each other, the first drain port 206 coupled with the first drain pipe member 215, the second drain port 207 coupled with the second drain pipe member 216, and the second channel 210 configured to allow the first drain port 206 and the second drain port 207 to communicate with each other and provided across the plurality of first channels 208.

With the configuration described above, after the work machine 1 is started, the hydraulic oil flows at a relatively lesser amount into the oil path configured to drain the hydraulic oil than an amount of the hydraulic oil flowing in the oil path configured to allow the hydraulic oil to flow from the pilot valves 185A, 185B, 185C, and 185D into the pressure receivers 180*a*, 180*b*, 180*c*, and 180*d* of the control valves 180. Even though a further time is required to warm up the oil paths, as long as the hydraulic oil flows into the second channel 210 at pressure lower than pressure of the hydraulic oil flowing in the first channels 208, the hydraulic oil flowing in the first channels 208 and the hydraulic oil flowing in the second channel 210 can exchange heat. The hydraulic oil flowing from the pilot valves 185A, 185B, 185C, and 185D into the pressure receivers 180*a*, 180*b*, 180*c*, and 180*d* of the control valves 180 can therefore warm up the hydraulic oil in the oil path configured to drain the hydraulic oil.

The plurality of first channels 208 are arranged to align with each other. The second channel 210 is provided to extend in the arrangement direction of the plurality of first channels 208.

With the configuration described above, the plurality of first channels 208 are arranged to align with each other in a single column. The relay member 200 can thus be formed thinner in a direction in which the first channels 208 are orthogonal to the second channel 210. Even when the relay member 200 is to be attached to a relatively narrower region, the relay member 200 can therefore be easily attached to the work machine 1.

The plurality of first channels 208 are arranged to align with each other in a plurality of columns. The second channel 210 is provided across the plurality of columns to extend in the arrangement direction of the plurality of first channels 208.

With the configuration described above, the hydraulic oil flowing in the second channel 210 can simultaneously exchange heat with both the hydraulic oil flowing in one column of the first channels 208 and the hydraulic oil flowing in another one column of the first channels 208. Efficiency in exchanging heat can therefore be further increased. Compared with a case where the first channels 208 are arranged in a single column, the relay member 200 can be formed smaller in the arrangement direction of the plurality of first channels 208. Even when the relay member 200 is to be attached to a relatively narrower region, the relay member 200 can therefore be easily attached to the work machine 1.

The second channel 210 is provided to extend in a direction orthogonal to the extending direction of the plurality of first channels 208.

With the configuration described above, the first pipe member 211, the second pipe member 212, the third pipe member 213, and the fourth pipe member 214 can be attached in different directions. The first pipe member 211, the second pipe member 212, the third pipe member 213, and the fourth pipe member 214 can therefore be easily arranged.

The second channel 210 is provided to extend and incline relative to the extending direction of the plurality of first channels 208.

With the configuration described above, compared with a case where the first channels 208 are orthogonal to the second channel 210, a region where the first channels 208 overlap with the second channel 210 can be fully secured. Efficiency in exchanging heat between the hydraulic oil flowing in the first channels 208 and the hydraulic oil flowing in the second channel 210 can therefore be further increased.

The plurality of first channels 208 are arranged around the second channel 210.

With the configuration described above, such a region that the first channels 208 overlap with the second channel 210, and that the hydraulic oil flowing in the first channels 208 warms up the hydraulic oil flowing in the second channel 210 from around the second channel 210 can be fully secured. Efficiency in exchanging heat between the first channels 208 and the second channel 210 can therefore be further increased.

The work machine 1 includes the hydraulic pump P1 configured to supply the hydraulic oil, the third pipe member 213 configured to allow the hydraulic oil supplied from the hydraulic pump P1 to flow, and the fourth pipe member 214 coupled to the plurality of pilot valves 185A, 185B, 185C, and 185D separately from the plurality of first pipe members 211. The relay member 200 includes the third channel 209 allowing the third pipe member 213 and the fourth pipe member 214 to communicate with each other.

With the configuration described above, the hydraulic oil supplied from the hydraulic pump P1 is relatively higher in temperature than the hydraulic oil flowing in the oil path configured to allow the hydraulic oil to flow from the pilot valves 185A, 185B, 185C, and 185D into the pressure receivers 180*a*, 180*b*, 180*c*, and 180*d* of the control valves 180. Efficiency in exchanging heat among the first channels 208, the third channel 209, and the second channel 210 can therefore be further increased.

The plurality of first channels 208 and the third channel 209 are arranged to align with each other. The second channel 210 is provided to extend in the arrangement direction of the plurality of first channels 208 and the third channel 209.

With the configuration described above, the plurality of first channels 208 are arranged to align with each other in a single column. The relay member 200 can thus be formed thinner in a direction in which the first channels 208 and the third channel 209 are orthogonal to the second channel 210. Even when the relay member 200 is to be attached to a relatively narrower region, the relay member 200 can therefore be easily attached to the work machine 1.

The plurality of first channels 208 and the third channel 209 are arranged to align with each other in a plurality of columns. The second channel 210 is provided across the plurality of columns to extend in the arrangement direction of the plurality of first channels 208 and the third channel 209.

With the configuration described above, the hydraulic oil flowing in the second channel 210 can simultaneously exchange heat with both the hydraulic oil flowing in one column of the first channels 208 and the third channel 209 and the hydraulic oil flowing in another one column of the first channels 208. Efficiency in exchanging heat can therefore be further increased. Compared with a case where the first channels 208 and the third channel 209 are arranged in a single column, the relay member 200 can be formed smaller in the arrangement direction of the plurality of first channels 208 and the third channel 209. Even when the relay member 200 is to be attached to a relatively narrower region, the relay member 200 can therefore be easily attached to the work machine 1.

The second channel 210 is provided to extend in a direction orthogonal to the extending direction of the plurality of first channels 208 and the third channel 209.

With the configuration described above, the plurality of first pipe members 211 and the plurality of second pipe members 212 being in communication with the plurality of first channels 208, the third pipe member 213 and the fourth pipe member 214 being in communication with the third channel 209, and the first drain pipe member 215 and the second drain pipe member 216 being in communication with the second channel 210 can be respectively attached in different directions. The plurality of first pipe members 211, the plurality of second pipe members 212, the third pipe member 213, the fourth pipe member 214, the first drain pipe member 215, and the second drain pipe member 216 can therefore be easily arranged.

The second channel 210 is provided to extend and incline relative to the extending direction of the plurality of first channels 208 and the third channel 209.

With the configuration described above, compared with a case where the first channels 208 and the third channel 209 are orthogonal to the second channel 210, a region where the first channels 208 and the third channel 209 overlap with the second channel 210 can be fully secured. Efficiency in exchanging heat between the hydraulic oil flowing in the first channels 208 and the third channel 209 and the hydraulic oil flowing in the second channel 210 can therefore be further increased.

The plurality of first channels 208 and the third channel 209 are arranged around the second channel 210.

With the configuration described above, such a region that the first channels 208 and the third channel 209 overlap with the second channel 210, and that the hydraulic oil flowing in the first channels 208 and the third channel 209 warms up the hydraulic oil flowing in the second channel 210 from around the second channel 210 can be fully secured. Efficiency in exchanging heat among the first channels 208, the third channel 209, and the second channel 210 can therefore be further increased.

The work machine 1 includes the hydraulic pump P1 configured to supply the hydraulic oil, the hydraulic actuators 62 and 63 each configured to be driven by the hydraulic oil, the plurality of control valves 180 configured to control the hydraulic actuators 62 and 63, the plurality of pilot valves 185A, 185B, 185C, and 185D configured to adjust the hydraulic oil serving as the pilot oil, the plurality of first pipe members 211 respectively coupled to the plurality of pilot valves 185A, 185B, 185C, and 185D and configured to allow the pilot oil output from the plurality of pilot valves 185A, 185B, 185C, and 185D to flow, the plurality of second pipe members 212 respectively coupled to the pressure receivers 180*a*, 180*b*, 180*c*, and 180*d* of the plurality of control valves 180, the first drain pipe member 215 configured to drain the hydraulic oil, the second drain pipe member 216 configured to return the hydraulic oil to the drain part configured to drain the hydraulic oil, the third pipe member 213 configured to allow the hydraulic oil supplied from the hydraulic pump P1 to flow, the fourth pipe member 214 coupled to the plurality of pilot valves 185A, 185B, 185C, and 185D separately from the plurality of first pipe members 211, and the relay member 200 including the plurality of inlet ports 202 coupled with the plurality of first pipe members 211, the plurality of outlet ports 203 coupled with the plurality of second pipe members 212, the plurality of first channels 208 configured to allow the plurality of inlet ports 202 and the plurality of outlet ports 203 to respectively communicate with each other, the first drain port 206 coupled with the first drain pipe member 215, the second drain port 207 coupled with the second drain pipe member 216, the second channel 210 configured to allow the first drain port 206 and the second drain port 207 to communicate with each other, the third channel 209 configured to allow the third pipe member 213 and the fourth pipe member 214 to communicate with each other, and the fourth channel 224 bifurcated from the third channel 209 and provided across the plurality of first channels 208 and the second channel 210.

With the configuration described above, the hydraulic oil supplied from the hydraulic pump P1 can exchange heat among the third channel 209, the first channels 208, and the second channel 210 due to its relatively higher temperature than a temperature of the hydraulic oil flowing in the oil path configured to allow the hydraulic oil to flow from the pilot valves 185A, 185B, 185C, and 185D into the pressure receivers 180*a*, 180*b*, 180*c*, and 180*d* of the control valves 180. The hydraulic oil supplied from the hydraulic pump P1 can therefore warm up the hydraulic oil flowing from the pilot valves 185A, 185B, 185C, and 185D into the pressure receivers 180*a*, 180*b*, 180*c*, and 180*d* of the control valves 180 and the hydraulic oil in the oil path configured to drain the hydraulic oil.

The relay member 200 is made of a metallic material.

The metallic material normally has higher heat conductivity. With the configuration described above, the hydraulic oil flowing in the second channel 210 can therefore be efficiently heated.

The present invention is described above. The embodiment disclosed herein is thought to be not restriction but an example in all aspects. The scope of the present invention is indicated not by the above description but by the claims, and is intended to include equivalent meanings to the claims and all modifications within the scope.

Obviously, numerous modifications and variations of the present invention are possible in light of the above teachings. It is therefore to be understood that within the scope of the appended claims, the invention may be practiced otherwise than as specifically described herein.

What is claimed is:

1. A work machine comprising:

a hydraulic actuator configured to be driven via hydraulic oil;

a control valve having a first pilot port and connected to the hydraulic actuator to control the hydraulic actuator, the hydraulic actuator being configured to move in a first mode when a first pilot pressure is applied to the first pilot port;

a first pilot oil supply pipe;

a first pilot valve connected to the first pilot port of the control valve via the first pilot oil supply pipe to control applying the first pilot pressure to the first pilot port;

a drain pipe via which the hydraulic oil is configured to be drained; and a heat exchanger in which the drain pipe and the first pilot oil supply pipe are provided to exchange heat between the hydraulic oil in the drain pipe and the hydraulic oil in the first pilot oil supply pipe via the heat exchanger.

2. The work machine according to claim 1, wherein the control valve has a second port, the hydraulic actuator being configured to move in a second mode different from the first mode when a second pilot pressure is applied to the second pilot port, wherein the work machine further comprises:

a second pilot oil supply pipe;

a second pilot valve connected to the second pilot port of the control valve via the second oil supply pipe to control applying the second pilot pressure to the second pilot port, and wherein the drain pipe and the second pilot oil supply pipe are provided in the heat exchanger to exchange heat between the hydraulic oil in the drain pipe and the hydraulic oil in the second pilot oil supply pipe via the heat exchanger.

3. The work machine according to claim 1, further comprising:

an additional hydraulic actuator configured to be driven via the hydraulic oil;

an additional control valve having an additional pilot port and connected to the additional hydraulic actuator to control the additional hydraulic actuator, the hydraulic actuator being configured to move in an additional mode when an additional pilot pressure is applied to the additional pilot port;

an additional pilot oil supply pipe;

an additional pilot valve connected to the additional pilot port of the additional control valve via the additional pilot oil supply pipe to control applying the additional pilot pressure to the additional pilot port of the additional control valve, wherein the drain pipe and the additional pilot oil supply pipe are provided in the heat exchanger to exchange heat between the hydraulic oil in the drain pipe and the hydraulic oil in the additional pilot oil supply pipe via the heat exchanger.

4. The work machine according to claim 2, wherein the first pilot oil supply pipe and the second pilot oil supply pipe are provided substantially in parallel to provide a gap between the first pilot oil supply pipe and the second pilot oil supply pipe, and wherein the drain pipe extends non-parallel to both of the first pilot oil supply pipe and the second pilot oil supply pipe such that the drain pipe does not pass through the gap and does not intersect with either of the first pilot oil supply pipe and the second pilot oil supply pipe.

5. The work machine according to claim 3, wherein the first pilot oil supply pipe and the additional pilot oil supply pipe are provided substantially in parallel to provide a gap between the first pilot oil supply pipe and the additional pilot oil supply pipe, and wherein the drain pipe extends non-parallel to both of the first pilot oil supply pipe and the additional pilot oil supply pipe such that the drain pipe does not pass through the gap and does not intersect with either of the first pilot oil supply pipe and the additional pilot oil supply pipe.

6. The work machine according to claim 3, wherein the first pilot oil supply pipe and the additional pilot oil supply pipe are provided substantially in parallel to provide a gap between the first pilot oil supply pipe and the additional pilot oil supply pipe, and wherein the drain pipe extends non-parallel to both of the first pilot oil supply pipe and the additional pilot oil supply pipe such that the drain pipe passes through the gap and does not intersect with either of the first pilot oil supply pipe and the additional pilot oil supply pipe.

7. The work machine according to claim 1, wherein the first pilot oil supply pipe extends in a first direction, and wherein the drain pipe extends in a second direction substantially perpendicular to the first direction as viewed in a third direction substantially perpendicular to the first direction and the second direction such that the drain pipe does not intersect with the first oil supply pipe.

8. The work machine according to claim 1, wherein the first pilot oil supply pipe extends in a first direction, and wherein the drain pipe extends in a second direction that is neither parallel nor perpendicular to the first direction as viewed in a third direction substantially perpendicular to the first direction and the second direction such that the drain pipe does not intersect with the first oil supply pipe.

9. The work machine according to claim 2, further comprising:

an additional hydraulic actuator configured to be driven via the hydraulic oil;

an additional control valve having an additional pilot port and connected to the additional hydraulic actuator to control the additional hydraulic actuator, the hydraulic actuator being configured to move in an additional mode when an additional pilot pressure is applied to the additional pilot port;

an additional pilot oil supply pipe; and an additional pilot valve connected to the additional pilot port of the additional control valve via the additional pilot oil supply pipe to control applying the additional pilot pressure to the additional pilot port of the additional control valve, wherein the drain pipe and the additional pilot oil supply pipe are provided in the heat exchanger to exchange heat between the hydraulic oil in the drain pipe and the hydraulic oil in the additional pilot oil supply pipe via the heat exchanger, and wherein the first pilot oil supply pipe, the second pilot oil supply pipe, and the additional pilot oil supply pipe are arranged around the drain pipe in the heat exchanger.

10. The work machine according to claim 1, further comprising:

an additional oil supply pipe; and a hydraulic pump configured to supply the hydraulic oil to the first pilot valve via the additional oil supply pipe, wherein the additional oil supply pipe is provided in the heat exchanger to exchange heat between the hydraulic oil in the additional oil supply pipe and the hydraulic oil in the first pilot oil supply pipe via the heat exchanger.

11. The work machine according to claim 10, wherein the first pilot oil supply pipe and the additional oil supply pipe are provided substantially in parallel to provide a gap between the first pilot oil supply pipe and the additional oil supply pipe, and wherein the drain pipe extends non-parallel to both of the first pilot oil supply pipe and the additional oil supply pipe such that the drain pipe does not pass through the gap and does not intersect with either of the first pilot oil supply pipe and the additional oil supply pipe.

12. The work machine according to claim 10, wherein the first pilot oil supply pipe and the additional oil supply pipe are provided substantially in parallel to provide a gap between the first pilot oil supply pipe and the additional oil supply pipe, and wherein the drain pipe extends non-parallel to both of the first pilot oil supply pipe and the additional oil supply pipe such that the drain pipe passes through the gap and does not intersect with either of the first pilot oil supply pipe and the additional oil supply pipe.

13. The work machine according to claim 11, wherein the first pilot oil supply pipe and the additional oil supply pipe extend in a first direction, and wherein the drain pipe extends in a second direction substantially perpendicular to the first direction as viewed in a third direction substantially perpendicular to the first direction and the second direction.

14. The work machine according to claim 12, wherein the first pilot oil supply pipe and the additional oil supply pipe extend in a first direction, and wherein the drain pipe extends in a second direction substantially perpendicular to the first direction as viewed in a third direction substantially perpendicular to the first direction and the second direction.

15. The work machine according to claim 12, wherein the first pilot oil supply pipe and the additional oil supply pipe extend in a first direction, and wherein the drain pipe extends in a second direction that is neither parallel nor perpendicular to the first direction as viewed in a third direction substantially perpendicular to the first direction and the second direction.

16. The work machine according to claim 10, wherein the control valve has a second port, the hydraulic actuator being configured to move in a second mode different from the first mode when a second pilot pressure is applied to the second pilot port, wherein the work machine further comprises:

a second pilot oil supply pipe;

a second pilot valve connected to the second pilot port of the control valve via the second oil supply pipe to control applying the second pilot pressure to the second pilot port, wherein the drain pipe and the second pilot oil supply pipe are provided in the heat exchanger to exchange heat between the hydraulic oil in the drain pipe and the hydraulic oil in the second pilot oil supply pipe via the heat exchanger, and wherein the first pilot oil supply pipe, the second pilot oil supply pipe, and the additional oil supply pipe are arranged around the drain pipe in the heat exchanger.

17. The work machine according to claim 10, further comprising:

an additional hydraulic actuator configured to be driven via the hydraulic oil;

an additional control valve having an additional pilot port and connected to the additional hydraulic actuator to control the additional hydraulic actuator, the hydraulic actuator being configured to move in an additional mode when an additional pilot pressure is applied to the additional pilot port;

an additional pilot oil supply pipe; and an additional pilot valve connected to the additional pilot port of the additional control valve via the additional pilot oil supply pipe to control applying the additional pilot pressure to the additional pilot port of the additional control valve, wherein the drain pipe and the additional pilot oil supply pipe are provided in the heat exchanger to exchange heat between the hydraulic oil in the drain pipe and the hydraulic oil in the additional pilot oil supply pipe via the heat exchanger, wherein the first pilot oil supply pipe, the additional pilot oil supply pipe, and the additional oil supply pipe are arranged around the drain pipe in the heat exchanger.

18. A work machine comprising:

a hydraulic pump configured to supply hydraulic oil;

a hydraulic actuator configured to be driven via the hydraulic oil;

a control valve having a first pilot port and connected to the hydraulic actuator to control the hydraulic actuator, the hydraulic actuator being configured to move in a first mode when a first pilot pressure is applied to the first pilot port;

a first pilot oil supply pipe;

an additional oil supply pipe;

a first pilot valve connected to the hydraulic pump via the additional oil supply pipe to receive the hydraulic oil and connected to the first pilot port of the control valve via the first pilot oil supply pipe to control applying the first pilot pressure to the first pilot port;

a branch pipe which is connected to the additional oil supply pipe; and a heat exchanger in which the branch pipe and the first pilot oil supply pipe are provided to exchange heat between the hydraulic oil in the branch pipe and the hydraulic oil in the first pilot oil supply pipe via the heat exchanger.

19. The work machine according to claim 18, wherein the first pilot oil supply pipe extends in a first direction, and wherein the branch pipe extends in a fourth direction non-parallel to the first direction as viewed in a fifth direction substantially perpendicular to the first direction and the fourth direction such that the branch pipe does not intersect with the first oil supply pipe.

20. The work machine according to claim 1, wherein the heat exchanger includes a metallic material member having a first hole and a second hole, a surface of the first hole defining an inner surface of a part of the first pilot oil supply pipe, a surface of the second hole defining an inner surface of a part of the second pilot oil supply pipe.

21. The work machine according to claim 2, wherein the first pilot oil supply pipe and the second pilot oil supply pipe are provided substantially in parallel to provide a gap between the first pilot oil supply pipe and the second pilot oil supply pipe, and wherein the drain pipe extends non-parallel to both of the first pilot oil supply pipe and the second pilot oil supply pipe such that the drain pipe passes through the gap and does not intersect with either of the first pilot oil supply pipe and the second pilot oil supply pipe.

22. The work machine according to claim 11, wherein the first pilot oil supply pipe and the additional oil supply pipe extend in a first direction, and wherein the drain pipe extends in a second direction that is neither parallel nor perpendicular to the first direction as viewed in a third direction substantially perpendicular to the first direction and the second direction.

* * * * *